US008561478B2

(12) United States Patent
Maute et al.

(10) Patent No.: US 8,561,478 B2
(45) Date of Patent: Oct. 22, 2013

(54) ROTATING FLUID MEASUREMENT DEVICE AND METHOD

(75) Inventors: Robert E. Maute, Richardson, TX (US); Feroze Sidhwa, Carrollton, TX (US)

(73) Assignee: REM Scientific Enterprises, Inc., Richardson, TX (US)

( * ) Notice: Subject to any disclaimer, the term of this patent is extended or adjusted under 35 U.S.C. 154(b) by 3 days.

(21) Appl. No.: 13/447,962

(22) Filed: Apr. 16, 2012

(65) Prior Publication Data

US 2012/0198927 A1 Aug. 9, 2012

Related U.S. Application Data

(62) Division of application No. 12/513,807, filed as application No. PCT/US2007/084329 on Nov. 9, 2007, now Pat. No. 8,156,799.

(60) Provisional application No. 60/865,184, filed on Nov. 10, 2006.

(51) Int. Cl.
*G01F 1/58* (2006.01)

(52) U.S. Cl.
USPC ..... 73/861.12

(58) Field of Classification Search
USPC ..... 73/861.11–861.17
See application file for complete search history.

(56) References Cited

U.S. PATENT DOCUMENTS

| | | | | |
|---|---|---|---|---|
| 2,842,961 A | | 7/1958 | Doll | |
| 3,076,334 A | | 2/1963 | Wiley | |
| 3,288,210 A | | 11/1966 | Bryant | |
| 3,328,679 A | | 6/1967 | Sloughter | |
| 3,530,713 A | | 9/1970 | Nazareth, Jr. | |
| RE28,989 E | | 10/1976 | Cushing | |
| 3,999,443 A | | 12/1976 | Appel et al. | |
| 4,170,133 A | | 10/1979 | Gardner | |
| 4,228,350 A | | 10/1980 | Paap et al. | |
| 4,432,143 A | | 2/1984 | Moriarty et al. | |
| 4,454,766 A | * | 6/1984 | Reinhold et al. | 73/861.12 |
| 4,513,624 A | | 4/1985 | McHale et al. | |
| 4,556,884 A | | 12/1985 | Howells et al. | |
| 4,631,969 A | | 12/1986 | Schmoock | |
| 4,704,907 A | | 11/1987 | Mannherz et al. | |

(Continued)

FOREIGN PATENT DOCUMENTS

| | | |
|---|---|---|
| CA | 2 577 581 A1 | 3/2003 |
| GB | 811 347 A | 4/1959 |

(Continued)

OTHER PUBLICATIONS

Maute, R.E., "A Guide to Diagnosing Your Wells: Production Logging," Probe Technology Services, Inc., 2000.

(Continued)

*Primary Examiner* — Jewel V Thompson
(74) *Attorney, Agent, or Firm* — Slater & Matsil, L.L.P.

(57) ABSTRACT

Fluid flow measurement device and method. In one embodiment, a tool comprises a rotating arm with a sensor pad to measure fluid flow into or out of the casing wall. The arm maintains the sensor pad in close proximity to the casing inner wall. The tool diameter is variable to allow the tool to traverse variable diameter casings and pass obstacles. The sensor pad comprises flow channels to direct the flow of fluid by electromagnetic sensors configured to detect conductive fluid flow.

38 Claims, 16 Drawing Sheets

(56) References Cited

U.S. PATENT DOCUMENTS

| | | | | |
|---|---|---|---|---|
| 4,757,873 | A | 7/1988 | Linyaev et al. | |
| 4,920,795 | A | 5/1990 | Codazzi et al. | |
| 4,938,073 | A | 7/1990 | Stephenson | |
| 4,953,398 | A | 9/1990 | Masson et al. | |
| 4,953,408 | A | 9/1990 | Appel et al. | |
| 4,969,363 | A | 11/1990 | Mochizuki | |
| 4,974,446 | A | 12/1990 | Vigneaux | |
| 5,251,479 | A | 10/1993 | Siegfried, II et al. | |
| 5,297,425 | A | 3/1994 | Hamby et al. | |
| 5,367,911 | A | 11/1994 | Jewell et al. | |
| 5,388,455 | A | 2/1995 | Hamby et al. | |
| 5,448,920 | A | 9/1995 | Ketelsen et al. | |
| 5,551,287 | A | 9/1996 | Maute et al. | |
| 5,596,142 | A | 1/1997 | Delpuech et al. | |
| 6,173,793 | B1 | 1/2001 | Thompson et al. | |
| 6,223,823 | B1 | 5/2001 | Head | |
| 6,237,424 | B1 | 5/2001 | Salmasi et al. | |
| 6,260,420 | B1 * | 7/2001 | Ketelsen et al. | 73/861.12 |
| 6,431,011 | B1 | 8/2002 | Feller | |
| 6,453,754 | B1 | 9/2002 | Florin | |
| 6,702,010 | B2 | 3/2004 | Yuratich et al. | |
| 6,711,947 | B2 | 3/2004 | Maute | |
| 6,779,407 | B2 | 8/2004 | Maute | |
| 6,854,342 | B2 * | 2/2005 | Payne et al. | 73/861.79 |
| 6,971,271 | B2 | 12/2005 | Maute | |
| 7,055,396 | B1 * | 6/2006 | Thai et al. | 73/861.12 |
| 7,509,852 | B2 | 3/2009 | Maute | |
| 7,574,907 | B2 | 8/2009 | Maute | |
| 7,628,080 | B1 * | 12/2009 | Feller | 73/861.12 |
| 2006/0290353 | A1 | 12/2006 | Fredette et al. | |
| 2007/0193776 | A1 | 8/2007 | Luling | |
| 2008/0307877 | A1 | 12/2008 | Cook et al. | |

FOREIGN PATENT DOCUMENTS

| | | | |
|---|---|---|---|
| GB | 2 056 691 | A | 3/1981 |
| GB | 2 064 130 | A | 6/1981 |
| GB | 2 253 907 | A | 9/1992 |
| GB | 2 405 214 | A | 2/2005 |
| JP | 58-17318 | | 2/1983 |
| WO | WO 01/11190 | A1 | 2/2001 |

OTHER PUBLICATIONS

Hill, A.D., et al., "Production Logging Tool Behavior in Two-Phase Inclined Flow," 56th Annual Fall Technical Conference and Exhibition of the Society of Petroleum Engineers of AIME, San Antonio, TX, Oct. 5-7, 1981.

Branagan, P., et al., "Tests Show Production Logging Problems in Horizontal Gas Wells," Oil & Gas Journal, Jan. 10, 1994, pp. 41-45.

Kelman, J.S., "Biphasic Fluid Studies for Production Logging in Large-Diameter Deviated Walls [sic]," The Log Analyst, Nov.-Dec. 1993, pp. 6-10.

Ding, Z.X. et al., "A Comparison of Predictive Oil/Water Holdup Models for Production Log Interpretation in Vertical and Deviated Wellbores," SPWLA 35th Annual Logging Symposium, Jun. 19-22, 1994, pp. 1-18.

Nice, S.B., "Production Logging in Horizontal Wellbores," 5th World Oil et al. Horizontal Well Technology Int. Conference (Houston) Proc., sect 11, Nov. 1993.

Zhu, D., et al. "The Effect of Flow from Perforations on Two-Phase Flow: Implications for Production Logging," 63rd Annual Technical Conference and Exhibition of the Society of Petroleum Engineers, Houston, TX, Oct. 2-5, 1988, pp. 267-275.

Molz, F.J., et al, "Development and Application of Borehole Flowmeters for Environmental Assessment," The Log Analyst, Jan.-Feb. 1993, pp. 13-23.

Ross, G., "The Electromagmetic Flowmeter as Applied to the Measurement of Blood Flow in Living Systems," Symposium on Flow: Its Measurement and Control in Science and Industry, vol. 1, Pittsburgh, PA, 1971, pp. 1337-1345.

Cushing, V.J., "Electromagnetic Water Current Meter," Water Resources Instrumentation, vol. 1 Measuring and Sensing Methods, Proceedings of the International Seminar and Exposition on Water Resources Instrumentation, Jun. 4-6, 1974, Chicago, IL, pp. 35-55.

Razi, M., et al., "Characterizing Flow through a Perforation Using Ultrasonic Doppler," Production Operations Symposium, Oklahoma City, OK, Apr. 2-4, 1995, pp. 943-953.

Baker, R.C., "A Review of Some Applications of Electromagnetic Flow Measurement," Symposium on Flow: Its Measurement and Control in Science and Industry, vol. 1, Part 2, Flow Measuring Devices, 1971, pp. 745-753.

Flood, J. "Single-Sensor Measurement of Flow in Filled or Partially Filled Process Pipes," Sensors Magazine, Sep. 1997.

Doney, B., "EMF Flow Measurement in Partially Filled Pipes," Sensors, Oct. 1999, pp. 65-68.

Maute, B., "Practical Interpretation of Production Logs," Version 9.0, Customized for the China National Oil and Gas Exploration & Development Corporation, Earth Resource and Environment Center, The University of Texas at Arlington, Dec. 17-19, 1997, pp. 1-160.

International Search Report for Corresponding International Application No. PCT/US02/16895, dated Sep. 24, 2002.

Kliman, G.B., "Calibration of an Electromagnetic Velocity Probe for Electrically Conducting Liquids," The Review of Scientific Instruments, No. 6, vol. 33, Jun. 1962, pp. 684-685.

Kolin, A., "Electromagnetic Velometry. I. A Method for the Determination of Fluid Velocity Distribution in Space and Time," Journal of Applied Physics, vol. 15, Feb. 1944, pp. 150-164.

Kolin, A., et al., "Electromagnetic Velometry. II. Elimination of the Effects of Induced Currents in Explorations of the Velocity Distribution in Axially Symmetrical Flow," Journal of Applied Physics, vol. 25, No. 4, Apr. 1954, pp. 409-413.

Norwegian Office Action with English Translation, Patent Application No. 20035479, Applicant: REM Scientific Enterprises, Inc., Dec. 4, 2008, 4 pages.

"Examiner's Report," Canadian Application No. 2,667,498, Applicant: REM Scientific Enterprises, Inc., Action Dated: Jul. 7, 2011, 3 pages.

* cited by examiner

ROTATING FLUID MEASUREMENT DEVICE AND METHOD

This is a divisional application of U.S. patent application Ser. No. 12/513,807, filed on May 6, 2009, entitled "Rotating Fluid Measurement Device and Method," which is a national filing under 35 U.S.C. §371 of International Patent Application No. PCT/US2007/084329, filed on Nov. 9, 2007, which claims the benefit of U.S. Provisional Patent Application No. 60/865,184, filed on Nov. 10, 2006, entitled "Rotating Fluid Measurement Device and Method," all of which applications are hereby incorporated herein by reference.

CROSS-REFERENCE TO RELATED APPLICATIONS

This application is related to the following co-pending and commonly-assigned patent applications: Ser. No. 12/947,402, filed Nov. 16, 2010, entitled "Fluid Flow Measuring Device and Method;" and Ser. No. 12/987,773, filed Jan. 10, 2011, entitled "Apparatus and Method for Fluid Flow Measurement with Sensor Shielding," which applications are hereby incorporated herein by reference.

TECHNICAL FIELD

The present invention relates generally to a device and method for fluid flow measurement and more particularly to a device and method for electromagnetic fluid flow measurement.

BACKGROUND

An oil and gas well is shown in FIG. 1 generally at 60. Well construction involves drilling a hole or borehole 62 in the surface 64 of land or ocean floor. The borehole 62 may be several thousand feet deep, and drilling is continued until the desired depth is reached. Fluids such as oil, gas and water reside in porous rock formations 68. A casing 72 is normally lowered into the borehole 62. The region between the casing 72 and rock formation 68 is filled with cement 70 to provide a hydraulic seal. Usually, tubing 74 is inserted into the hole 62, the tubing 74 including a packer 76 which comprises a seal. A packer fluid 78 is disposed between the casing 72 and tubing 74 annular region. Perforations 80 may be located in the casing 72 and cement 70, into the rock 68, as shown.

Production logging involves obtaining logging information about an active oil, gas or water-injection well while the well is flowing. A logging tool instrument package comprising sensors is lowered into a well, the well is flowed and measurements are taken. Production logging is generally considered the best method of determining actual downhole flow. A well log, a collection of data from measurements made in a well, is generated and is usually presented in a long strip chart paper format that may be in a format specified by the American Petroleum Institute (API), for example.

The general objective of production logging is to provide information for the diagnosis of a well. A wide variety of information is obtainable by production logging, including determining water entry location, flow profile, off depth perforations, gas influx locations, oil influx locations, non-performing perforations, thief zone stealing production, casing leaks, crossflow, flow behind casing, verification of new well flow integrity, and floodwater breakthrough, as examples. The benefits of production logging include increased hydrocarbon production, decreased water production, detection of mechanical problems and well damage, identification of unproductive intervals for remedial action, testing reservoir models, evaluation of drilling or completion effectiveness, monitoring Enhanced Oil Recovery (EOR) process, and increased profits, for example. An expert generally performs interpretation of the logging results.

In current practice, measurements are typically made in the central portion of the wellbore cross-section, such as of spinner rotation rate, fluid density and dielectric constant of the fluid mixture. These data may be interpreted in an attempt to determine the flow rate at any point along the borehole. Influx or exit rate over any interval is then determined by subtracting the flow rates at the two ends of the interval.

In most producing oil and gas wells, the wellbore itself generally contains a large volume percentage or fraction of water, but often little of this water flows to the surface. The water that does flow to the surface enters the wellbore, which usually already contains a large amount of water. The presence of water already in the wellbore, however, makes detection of the additional water entering the wellbore difficult and often beyond the ability of conventional production logging tools.

Furthermore, in deviated and horizontal wells with multiphase flow, and also in some vertical wells, conventional production logging methods are frequently misleading due to complex and varying flow regimes or patterns that cause misleading and non-representative readings. Generally, prior art production logging is performed in these complex flow regimes in the central area of the borehole and yields frequently misleading results, or may possess other severe limitations. Often the location of an influx of water, which is usually the information desired from production logging, is not discernable due to the small change in current measurement responses superimposed upon large variations caused by the multiphase flow conditions.

As described in commonly owned U.S. Pat. No. 6,711,947, entitled "Fluid Flow Measuring Device and Method of Manufacturing Thereof," issued Mar. 30, 2004, and WO Publ. No. 2005/033633 A2, entitled "Apparatus and Method for Fluid Flow Measurement with Sensor Shielding," filed Mar. 31, 2006, all of which are hereby incorporated herein by reference, one fluid flow measurement implementation approach involves using one or more coils of wire in an approximate elliptical shape with an expanding loop of wire of the same shape as the coil(s). The loop may allow the wire coil(s) to constrict and elongate to run a measurement tool into a wellbore through smaller diameter tubulars and then expand upon entry into larger diameter casings. This approach, however, may have a difficulty in some applications in that a coil of wire with multiple turns of wire may be mechanically difficult to constrict, and also may be mechanically difficult to expand.

SUMMARY OF THE INVENTION

These and other problems are generally solved or circumvented, and technical advantages are generally achieved, by embodiments of the invention that provide fluid flow detection and measurement for a wellbore, casing, or other conduit. Implementations disclosed by U.S. Pat. No. 6,711,947, in addition to the sensor loop, include electromagnetic flow measurement utilizing one pair of electrodes on a rotating arm to sweep around the casing inner wall, and a plurality of small individual electromagnetic sensors (e.g. one electrode pair) used on each of a multiply-armed caliper tool. Embodiments disclosed herein provide improvements to tool body, tool arm and sensor devices and methods for fluid flow measurement.

In accordance with an embodiment of the present invention, a logging tool for a borehole comprises a tool body having a long axis, a sensor pad, and an arm assembly coupling the sensor pad to the tool body, wherein the arm assembly is pivotably attached to the tool body, wherein a pivot axis of the arm assembly is orthogonal to the long axis of the tool body, and wherein the sensor pad is movable radially inward toward or outward from the tool body as the arm assembly is pivoted on the pivot axis.

In accordance with an embodiment of the present invention, a conductive fluid flow measurement device comprises a core enclosure having first, second, third and fourth sides, a first pole piece having a first face and disposed inside the first side the core enclosure, a second pole piece having a second face and disposed inside the second side of the core enclosure opposite the first side, wherein the first and second faces face each other and are separated by a gap, one or more flow channels disposed from the third side of the core, through the gap, to the fourth side of the core opposite the fourth side, and one or more electrode pairs, wherein each electrode pair is disposed in a respective one of the one or more flow channels adjacent the gap, and wherein, for each electrode pair, an imaginary line between the two electrodes in the electrode pair is substantially parallel to the faces and substantially orthogonal to a flow axis of the respective flow channel.

In accordance with an embodiment of the present invention, a conductive fluid flow measurement device comprises a core enclosure, first and second permanent magnets disposed adjacent the core enclosure, a first pole projection and a second pole projection disposed on the first and second permanent magnets, respectively, within the core enclosure and separated by a gap, a flow channel disposed within the core enclosure proximate to the gap such that a conductive fluid flowing through the flow channel passes through the gap, and an electrode pair disposed in the flow channel adjacent the gap, wherein a voltage difference is generated between electrodes in the electrode pair when the conductive fluid flows through the flow channel.

In accordance with an embodiment of the present invention, a conductive fluid flow measurement device comprises two permanent magnets with opposite poles facing each other and separated by a gap, a plurality of flow channels disposed within the device proximate to the gap such that a conductive fluid flowing through at least one of the flow channels passes through the gap, and a plurality of electrode pairs disposed adjacent the gap along a length of the permanent magnets, wherein a voltage difference occurs between the electrodes when the conductive fluid flows through at least one of the flow channels.

In accordance with an embodiment of the present invention, a method of measuring a conductive fluid flow comprises traversing a casing with a tool body having a quadrilateral arm assembly supporting a sensor pad comprising an electromagnetic sensor, azimuthally rotating the sensor pad along an inner circumference of the casing, and measuring a speed and direction of radial conductive fluid flow.

An advantage of an embodiment of the present invention is that mechanical contraction or expansion of a multiple-turn wire coil may be avoided through the use of one or more sensor pads disposed on one or more arm assemblies.

An advantage of another embodiment of the present invention is that an arm assembly may maintain a sensor pad proximate to the sides of the casing so that fluid flow at the sides of the casing may be measured without interference from the fluids in the middle of the casing. Additionally, the arm assembly may maintain the sensor proximate to the inner circumference of the casing when the casing deviates from a vertical alignment.

An advantage of yet another embodiment of the present invention is that a sensor may generate a large magnetic field which generally enables better detection of fluid flow. Also, the sensor generally distinguishes between conductive fluid flow and non-conductive fluid flow.

BRIEF DESCRIPTION OF THE DRAWINGS

For a more complete understanding of the present invention, and the advantages thereof, reference is now made to the following descriptions taken in conjunction with the accompanying drawing, in which.

For a more complete understanding of the present invention, and the advantages thereof, reference is now made to the following descriptions taken in conjunction with the accompanying drawing, in which:

Corresponding numerals and symbols in the different figures generally refer to corresponding parts unless otherwise indicated. The figures are drawn to clearly illustrate the relevant aspects of the illustrative embodiments; while some figures are drawn to scale, other figures are not necessarily drawn to scale.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, namely a fluid flow measurement tool used in a wellbore. The invention may also be applied, however, to other applications where the detection of conductive fluid flow is useful, such as pipes, casings, drill shafts, tanks, and swimming pools. The measurement tool may be used in vertical, deviated, and horizontal wells, and may be used in tubing, casing, slotted screens, slotted liners, and almost any well completion. Any type of conduit, wellbore, cylinder, pipe, shaft, tube, etc. is referred to herein generally as a casing.

Figure 1:
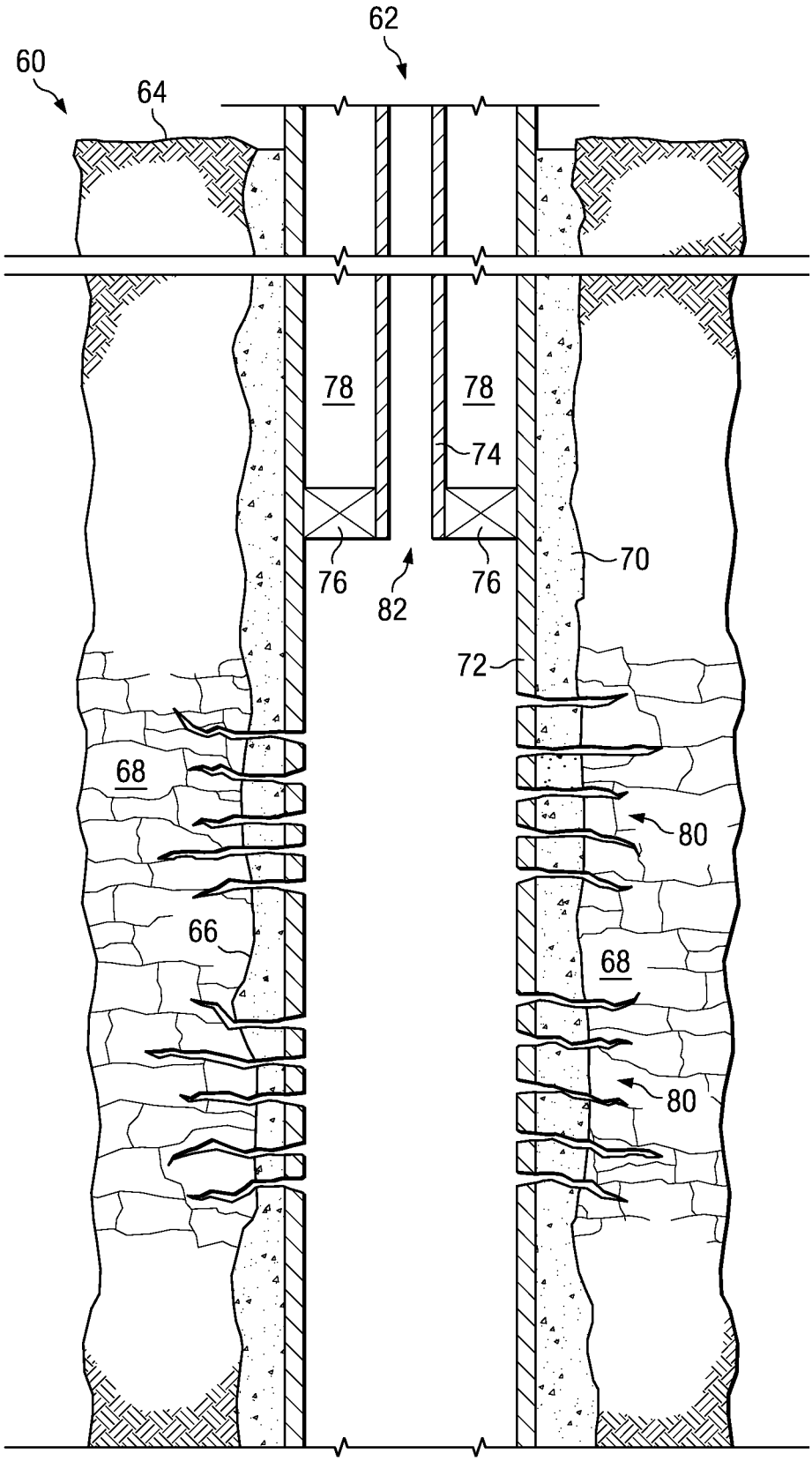
FIG. 1 is a cross-sectional view of an oil or gas well.
Figure 2A:
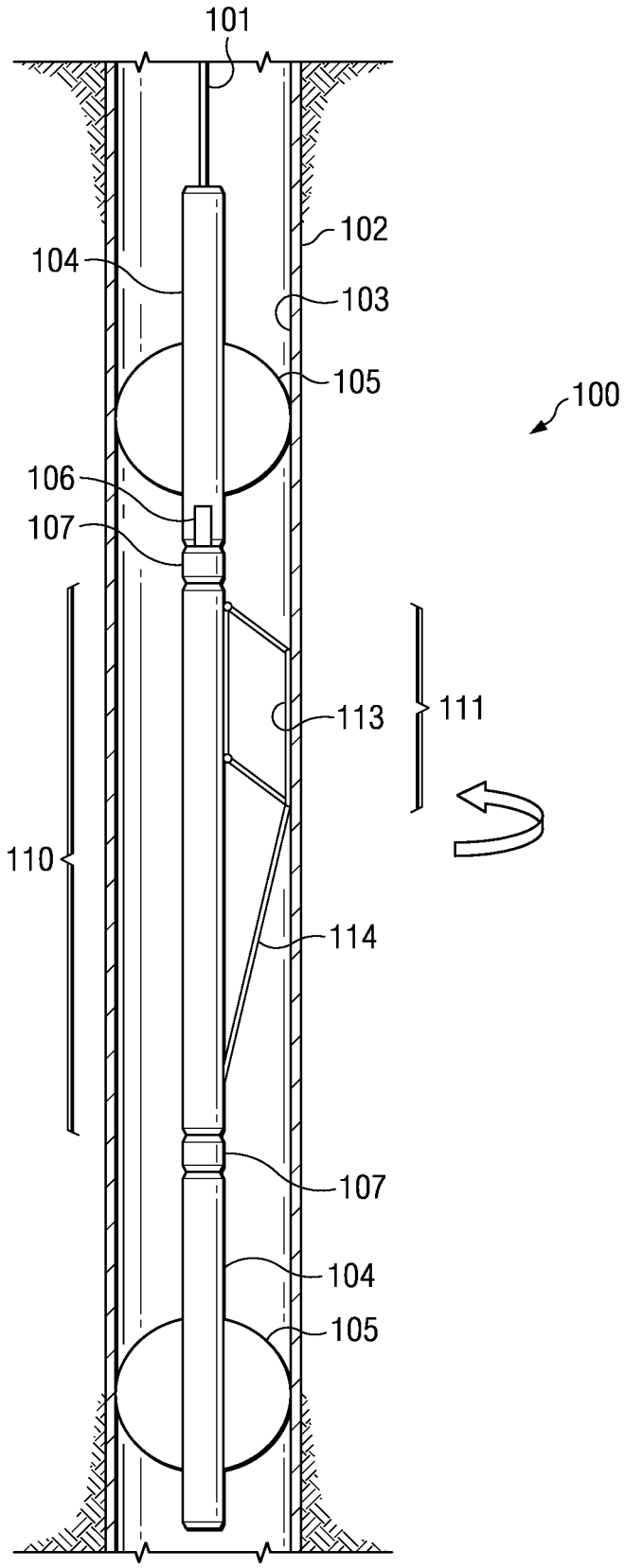
FIG. 2A illustrates an embodiment of a logging tool string.

Referring to FIG. 2A, a downhole measuring device for a wellbore is shown as sonde or tool string 100, which is configured to traverse a casing 102 with sensor pad 113. The general features of a measurement tool and the basic operation of an electromagnetic fluid flow sensor are disclosed in U.S. Pat. No. 6,711,947 and WO Publ. No. 2005/033633 A2, incorporated by reference above, which may be referenced for an understanding of these general concepts. With respect to the embodiment of FIG. 2A, tool 100 typically is lowered into and raised out of casing 102 on a wireline 101. The tool 100 azimuthally sweeps or rotates the sensor pad 113 on arm assembly 111 about the inner circumference 103 of the casing 102 as the tool 100 axially traverses the casing 102. Preferably, sensor pad 113 is maintained in contact or in close proximity to the wellbore wall 103.

Tool 100 includes stationary tool segments 104 and rotatable tool segment 110. A majority of the components of the tool bodies are preferably non-magnetic and preferably corrosion resistant materials, such as stainless steel, titanium, and the like. Stationary tool body 104 is preferably non-rotating, and is connected to rotating tool segment 110 by rotating joint 107, which allows for electrical communications (signals and power) to pass between the rotating tool segment 110 and at least one of the stationary tool segments 104. Rotating joint 107 may constitute slip rings or a wireless (e.g., radio frequency) transceiver pair for communication, as examples. Stationary tool body 104 may include one segment or preferably two segments with one being below the rotating tool body 110 and the other being above it and attached to wireline cable 101. Slip rings may be added at the bottom rotating joint 107 if other measurement tools are desired to be located below rotating tool segment 110.

Attached to stationary tool body 104 is at least one, but preferably two, three, four or more centralizers 105. Centralizers 105 generally maintain a long axis of the tool body 100 substantially parallel to the axis of casing 102, as well as substantially in the center of casing 102, thus generally maintaining sensor pad 113 in proximity to the wellbore wall 103 and substantially parallel to the axis of casing 102. Additionally, the centralizers generally keep rotation of stationary tool body 104 to a minimum while rotating tool body 110 rotates. Centralizers 105 may be made of metal ribbons or wires for example.

Rotating tool body 110 (along with arm assembly 111 and sensor pad 113) may be rotated by motor 106 located within stationary tool body 104. In other embodiments, the rotating tool body may be rotated by other mechanisms such as gears driven by axial motion of the tool body 100 through casing 102. In addition, motor 106 or other rotating mechanism may be located in another part of the tool 100, such as within the rotating tool body 110, or outside of the tool such as higher up on the wireline 101 or above ground. A clutch may be used with the motor for protection in case the sensor pad hangs up during rotation and stops rotating.

Generally, substantially all exposed parts of sonde 100, including rotating tool segment 110 and sensor pad 113, are smoothed and rounded to prevent sonde 100 from hanging up or snagging against any protrusions, tubular ends, tubular lips, seating nipples, gas lift mandrels, packers, etc., within a borehole.

In operation, a sensor(s) within the sensor pad 113 detects the radial component of conductive fluid, such as water, entering or leaving the wellbore through the wellbore wall. Preferably, tool 100 is slowly moved axially at a speed such that, while sensor pad 113 is rotating, generally the entire or substantially all of the inner area of the wellbore wall portion to be measured is covered by the sensor area of sensor pad 113. Alternatively, the sensor may sweep across overlapping swaths of the detected spiral area to ensure full coverage of the borehole wall, even if the axial speed of the tool varies. Tool 100 may make one, two or more axial passes through a wellbore while logging measurements made with sensor pad 113. Normally logging may be performed from the bottom upward, but logging also may be performed while moving in the downward direction.

In one embodiment, the rotation rate of the rotating tool segment may be measured, so that a computer or log interpreter can determine if the tool stops rotating and thus determine the portion of the borehole inner wall not logged and over what depth interval that occurs.

Figure 2B:
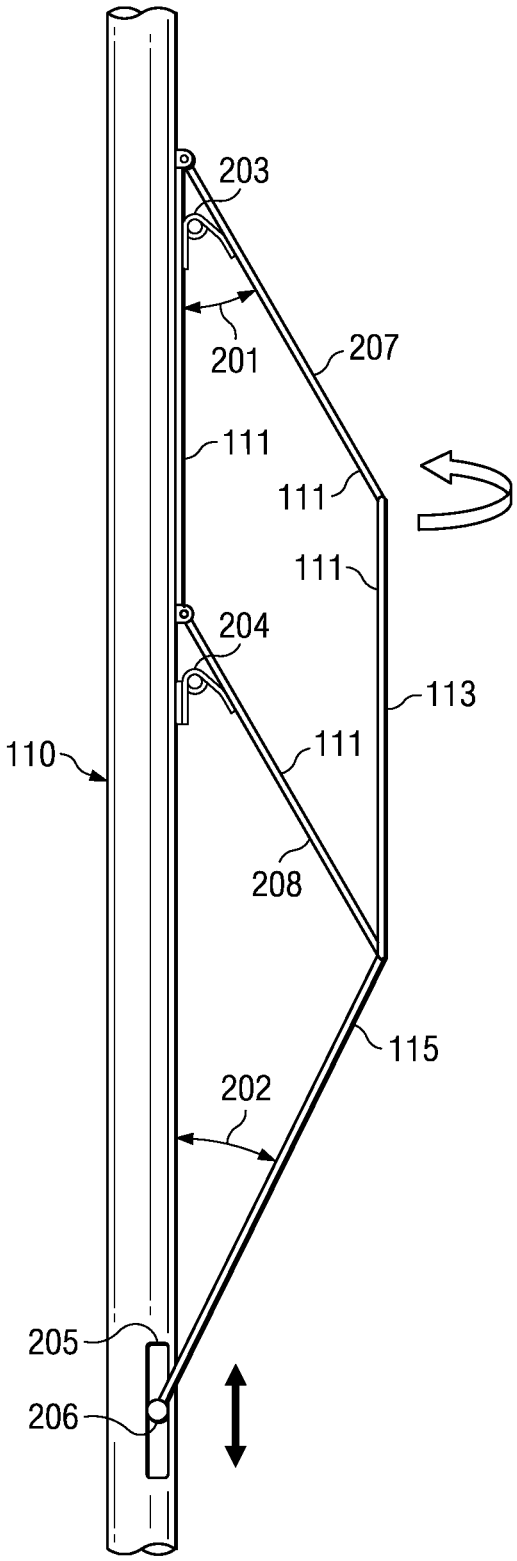
FIGS. 2B & 2C show embodiments of a logging tool arm assembly.

FIG. 2B shows an embodiment of arm assembly 111, which includes upper arm 207 and lower arm 208. Upper arm 207 and lower arm 208 are pivotably connected at one end to rotating tool body 110. The other ends of arm 207 and arm 208 are connected to opposite ends of sensor pad 113, thus generally forming a parallelogram. Alternatively, the other ends of the arms may be connected to a mounting arm or bracket providing a mounting surface for sensor pad 113. The mounting bracket preferably comprises an open area behind the sensor area of sensor pad 113 to allow for the free flow of fluid into sensor pad 113 and out the back of the mounting bracket. Any type of mechanical connector that allows pivoting of the arms 207, 208 may be used to attach the arms to rotating tool body 110 and sensor pad 113. Connector types such as hinges, pin and slot, or combinations of these are some examples. This arm arrangement generally keeps sensor pad 113 substantially parallel to the axis of the casing, which may enable accurate measurements. In another embodiment, sensor pad 113 may be connected to the rotating tool body by only a single arm.

In other embodiments, the arm assembly 111 connections with upper arm 207, lower arm 208, rotating tool body 110, and sensor pad 113 may create a quadrilateral shape or a substantially oval or circular shape, as examples. While this embodiment and the descriptions of other embodiments that follow refer to arm assembly 111 as connected to rotating tool body 110, the arm assembly also could be connected to stationary tool body 104. Alternatively, in some embodiments of tool 100, the rotating tool body 110 may be omitted. As another alternative, there may be two, three, four or more arm assemblies in any of the above configurations.

Maintaining the arm assembly 111 against a casing wall may be accomplished in many different ways. In one embodiment, springs 203, 204 are used to exert outward force on upper arm 207 and lower arm 208 to push them away from rotating tool body 110. A torsion spring is one example of a type of spring which may be used for springs 203, 204. The angle 201 between upper arm 207 and rotating tool body 110 is preferably maintained between about 15 and about 45 degrees, more preferably between about 20 and about 40 degrees, still more preferably between about 25 and about 35 degrees, and most preferably at about 30 degrees, depending on the specific application. Limiting the maximum deviation from vertical of angle 201 helps to ensure smoother passage of the tool 100 into smaller diameter casings from larger diameter casings, and around obstacles.

Alternatively, springs may be implemented at the interface of the arms to the sensor pad, in addition or in place of the above springs. Preferably, the hinges and springs have sufficient strength to withstand the rotational torque during operation, including during rotational hang up. Furthermore, the hinges and springs preferably are debris resistant.

Figure 2C:
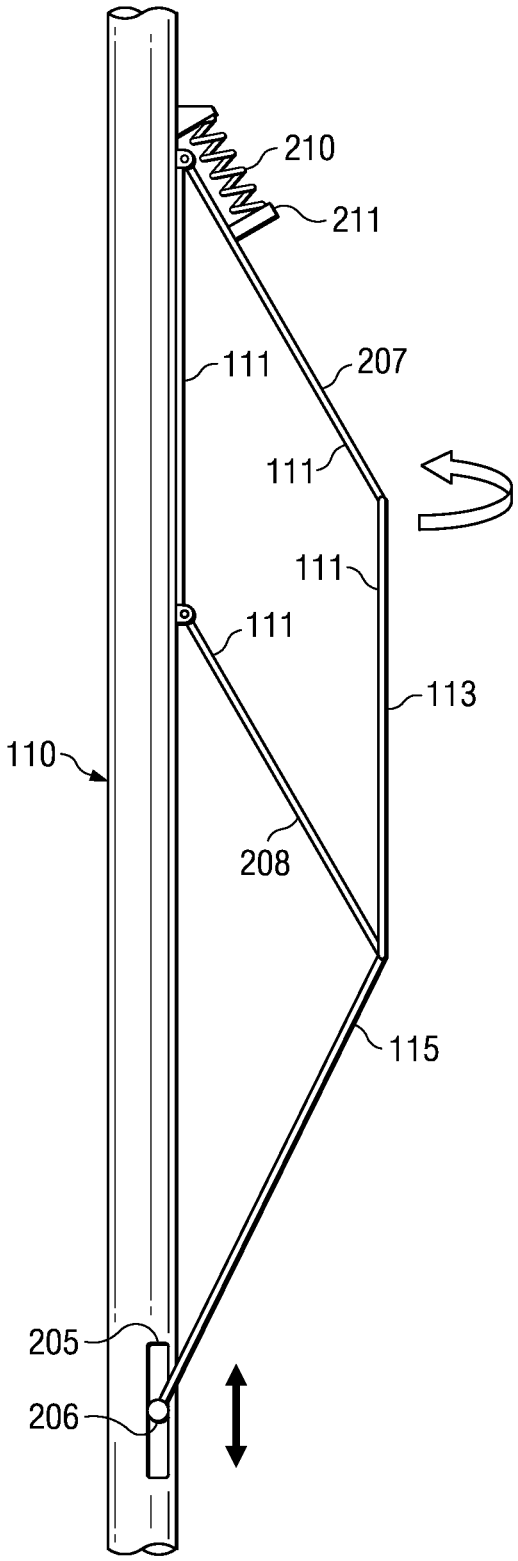

FIG. 2C shows another embodiment of arm assembly 111 with spring 210 and bar 211. Spring 210 is connected to the rotating tool body 110 and to bar 211, which is connected to one of the assembly arms 207 or 208. Preferably, bar 211 comprises a groove to maintain spring 210 substantially in the center of bar 211. As an example, an extension spring is one type of spring which may be used for spring 210. Spring 210 exerts an outward force on arm assembly 111 to maintain sensor pad 113 in contact with or in close proximity to a casing wall.

Alternatively, the arm assembly may be motorized and use the force of a motor to maintain the sensor pad against the sensor wall. A feedback loop may be implemented to assist in controlling the motor. As yet another alternative, a force system on the arm assembly provides a close to a constant force of the sensor pad against the inner wall of the borehole, independent of the diameter that the arm assembly is open. This may be achieved, for example, by a counter spring to the torsional or extension spring that has about the same force characteristics but with an inverse direction of movement. Other alternatives include a non-uniformly shaped spring, a second spring that initiates at some position in the movement of the arm assembly, or a many-turn torsional spring.

Referring back to FIG. 2B, arm assembly 111 additionally may comprise a long arm 115 connected to the lower end of lower arm 208 or sensor pad 113. Long arm 115 is pivotably coupled to rotating tool body 110. The angle 202 between long arm 115 and rotating tool body 110 is preferably between about 4 and about 10 degrees, more preferably between about 5 and about 9 degrees, more preferably between about 6 and about 8 degrees, and most preferably about 7 degrees, depending on the specific application. Maintaining the small angle assists with smoother passage of tool 100 through smaller diameter casings, around obstacles and restrictions, and also assists in collapsing the tool into its reduced diameter mode (described below). Long arm 115 may be coupled to rotating tool body 110 by any mechanism that allows the angles between long arm 115 and rotating tool body 110 to change. Preferably, long arm 115 is coupled to rotating tool body 110 by pin 206 and slot 205 connector. This connection allows for pin 206 to slide within slot 205 allowing long arm 115 to pivot and to expand out or fold flat against or into rotating tool segment 110.

Figure 3A:
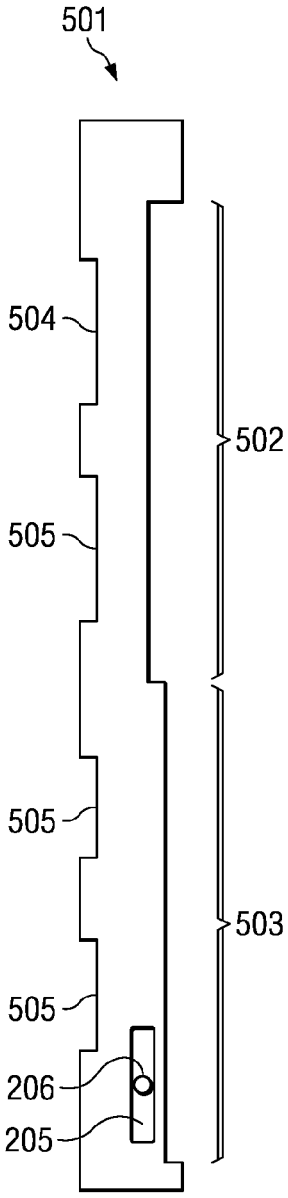
FIGS. 3A & 3B show various views of an embodiment of an arm assembly carrier.
Figure 3B:
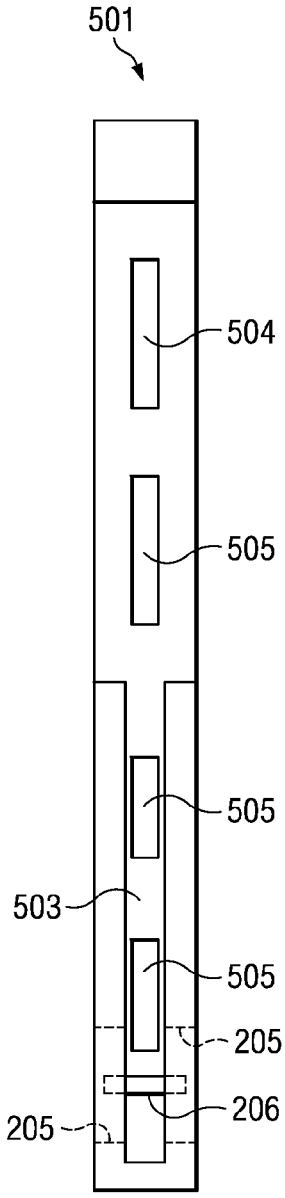

FIGS. 3A and 3B illustrate side and front views, respectively, of an embodiment of rotating tool body 110 with an added feature of carrier 501. Carrier 501 allows arm assembly 111 and long arm 115 to fold into hollow regions of rotating tool body 110 when compressed. In one embodiment, arm assembly 111 folds into upper hollow section 502 and long arm 115 folds into lower hollow section 503. The middle of carrier 501 has fluid flow cutout 504 and debris cutouts 505. Fluid flow cutout 504 is aligned with sensor pad 113 to allow for fluid passing through the sensor area of sensor 113 to exit through the back of carrier 501.

Carrier 501 generally may permit tool 100 and sensor pad 113 to operate even when arm assembly 111 is compressed into carrier 501. Debris cutouts 505 allow for debris and fluid to be pushed out of the carrier 501 so there will not be any obstructions as arm assembly 111 and long arm 115 compress into carrier 501. Carrier 501 also may provide mechanical strength to keep the more delicate portions of the tool intact, for example, when tagging bottom or when running into an obstacle.

Figure 4:
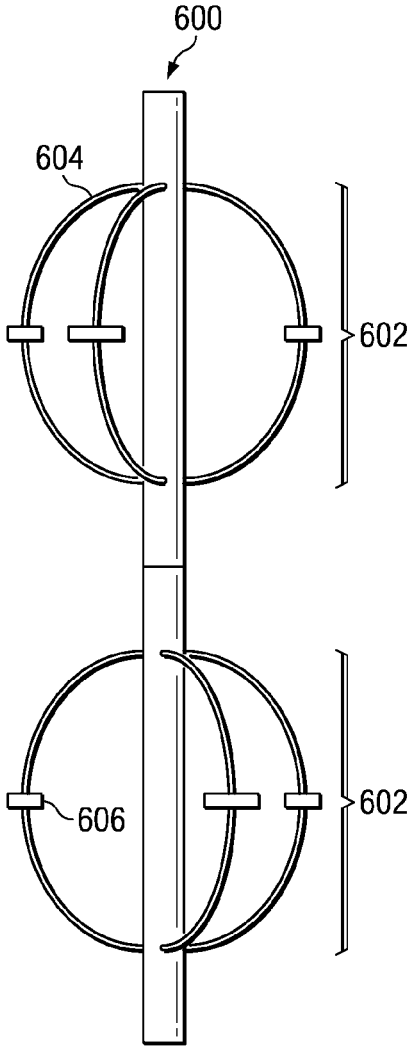
FIG. 4 illustrates a non-rotating, multiple arm embodiment.

FIG. 4 illustrates an alternative embodiment non-rotating multiple arm tool 600. Tool 600 utilizes multiple bow spring arms 604 that passively or actively expand or contract to accommodate any changes in the borehole inner diameters, such as when traversing from tubing to casing or vice versa. For the bow spring arms, bowed (or other shape) wire-like flexible expandable and contractible wires may be used like bow springs. A small sensor pad 606 with transverse (to the borehole axis) flow channels is disposed on a part of the bow spring that is farthest radially outward. The bow spring maintains the sensor pad against a casing inner wall. Each sensor pad 606 may cover a swath of the inner wall of the borehole. With a selected number of bow springs and sensor pads used in a selected offset pattern, generally the entire or substantially all of the inner area of the borehole portion to be measured may be covered. Alternatively, a series of bow spring tool segments 602, each section offset azimuthally with respect to the others, may be used to cover substantially the entire inner area of the borehole.

While FIG. 4 shows two segments 602, alternatively, in some embodiments, there may be only one segment, or there may be three, four, five, six or more segments, depending upon the specific application. In addition, while FIG. 4 shows three bow springs on each segment, alternatively, in some embodiments, there may be one or two bow springs per segment, there may be four, five, six, seven, eight or more bow springs per segment, depending upon the specific application. Alternatively, one or more of the segments may rotate.

Figure 5A:
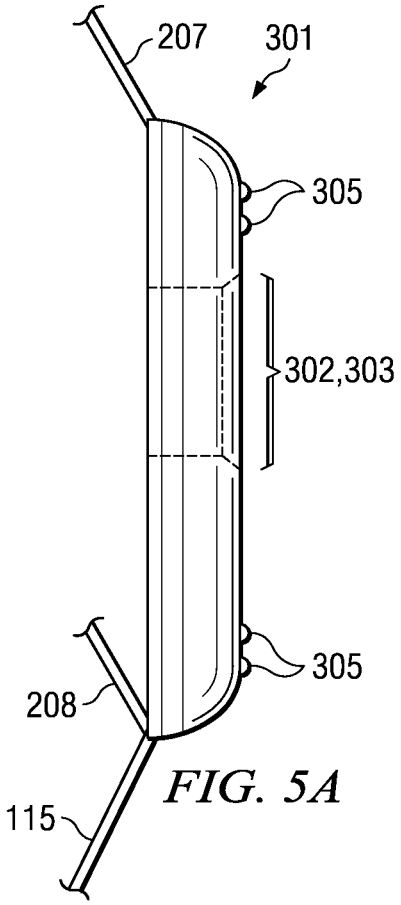
FIGS. 5A, 5B, and 5C show different views of an embodiment of a sensor housing.
Figure 5B:
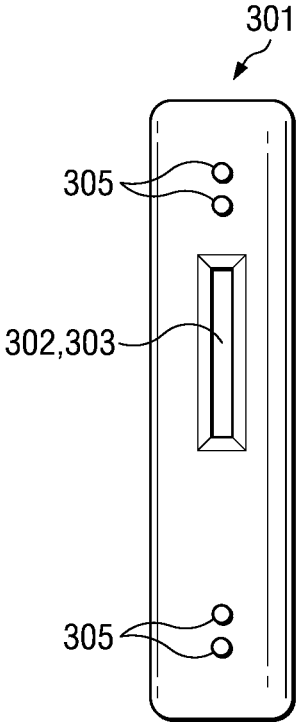
Figure 5C:
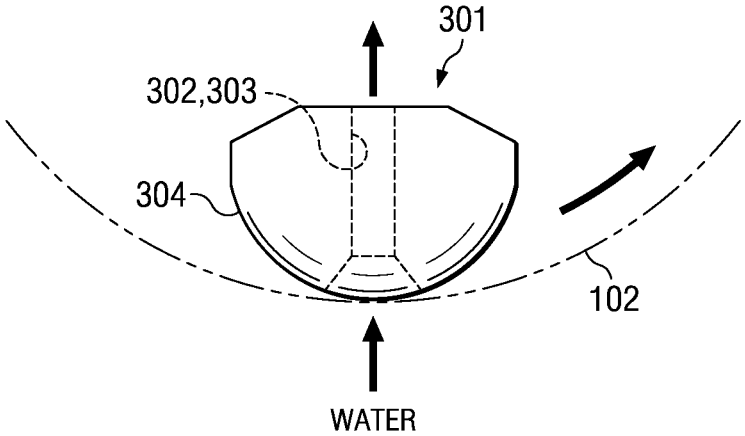

FIGS. 5A, 5B and 5C illustrate side, front and top views, respectively of sensor pad 113. The sensor pad includes sensor housing 301 which has rounded front face 304, flow channel 303, and sensor 302 within flow channel 303. Sensor housing 301 generally moves along the inner circumference of casing 102 allowing fluid entering or leaving the casing wall to flow along a flow axis of flow channel 303 past sensor 302. Flow channel 303 is preferably between about 3 and about 10 inches long, more preferably between about 4 and about 9 inches long, still more preferably between about 5 and about 8 inches long, and most preferably between about 6 and about 7 inches long, but may be longer or shorter depending on the length of sensor 302 used in a particular application. As explained in more detail below, flow channel 303 and sensor 302 preferably comprise multiple individual flow channels and associated sensors.

Rounded front face 304 of sensor housing 301 generally allows for smoother passage through tubulars and around obstructions. Additionally, all-direction ball rollers 305 may be incorporated on face 304 of housing 301 to aid in passage around obstacles and to reduce friction and wear on the surface of sensor housing 301. Preferably, several rollers may be used, so that if any one rolled over a perforation hole it would not lodge in the perforation hole and hang up the sensor pad from moving. Other options for reducing pad wear also may be used, such as a sheath that holds the sensor arm assembly fully closed, and then automatically drops off or is removed when entering a region with a larger-than-tubing size diameter, such as a casing. Another alternative is a sacrificial ring or sleeve that wears on the trip into the hole and drops off when in the casing, taking the wear on the trip into the hole instead of the pad face taking the wear. Sensor pad 113, the sensor pad face or the ball rollers may be configured so as to be easily replaceable.

Sensor pad 113, including sensor housing 301 and sensor 302 within sensor housing 301, may be a permanent or removable component of arm assembly 111. The sides and back of the sensor pad preferably are shaped so as to provide a large volume for the sensor itself inside the pad and yet still allow the pad to fit inside a carrier. The carrier generally will be mechanically stronger than the sensor components, and may assist in withstanding large axial and other forces that may be placed upon the tool string in practice. While throughout this discussion sensor 302 is typically described as a flow sensor, tool 100 and arm assembly 111 also may be used with other types of sensors such as temperature, pressure, conductivity, orientation, imaging, and the like.

Sensor pad 113 may also comprise other types of sensors, such as one or more temperature sensors. For example, an array of temperature sensors may be used to image the borehole temperature distribution.

Figure 6A:
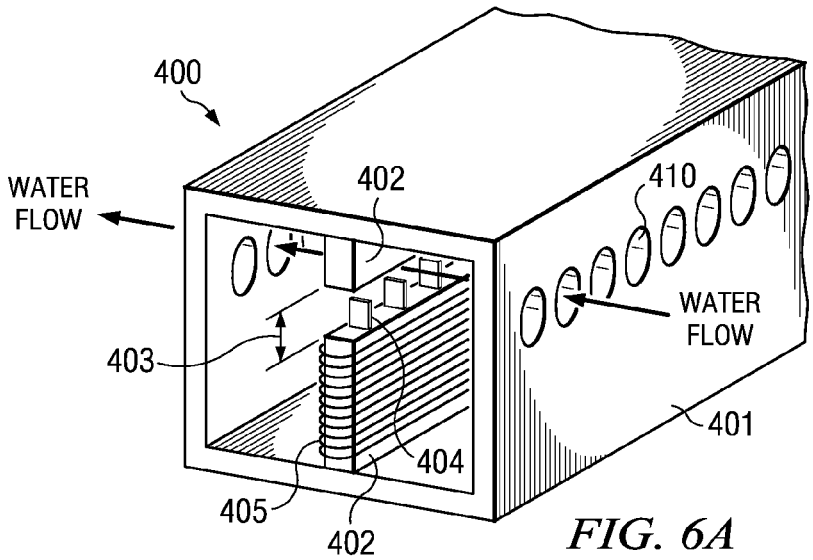
FIGS. 6A-6K show various views and components of flow sensor embodiments.

FIG. 6A illustrates flow sensor 400, which includes core body 401. Inside core body or shell 401 are first and second pole sections 402 preferably extending about the length of core enclosure 401. Core body 401 and pole sections 402 preferably comprise a material of high magnetic permeability such as iron (e.g., 1015 iron), steel (e.g., 1018 steel), and the like. The length of core body 401 is preferably between about 4 inches and about 10 inches, more preferably between about 5 inches and about 8 inches, and most preferably about six inches long. The two pole sections 402 preferably are separated by gap 403. Alternatively, only one pole section 402 may be used such that the gap 403 exists between the single pole piece and the core. The width of gap 403 is preferably less than 0.5 inches, more preferably less than 0.4 inches, still more preferably between 0.1 and 0.3 inches, and most preferably about 0.2 inches, depending on the specific application. These preferred distances also apply to the spacing between the two electrodes 404 in an electrode pair disposed in each flow channel.

At least one, and preferably both, of the pole pieces 402 are surrounded by wire coil 405, which carries electrical current to generate a substantially constant magnetic flux along the faces of pole pieces 402, and concentrated primarily between the two pole pieces. The coil may be coated in enamel or other waterproof material. As another alternative, the coil may be coiled around the outer portion of the core, that is, the coil may be wound around from the inside to the outside of the core. As another alternative, permanent magnets may be used instead of the magnetic pieces and wire coil.

Electrodes 404 are situated in gap 403 between the two pole pieces 402, with two electrodes disposed in each flow channel. The electrode pairs preferably are spaced along first pole piece 402 at a distance of preferably less than about 0.25 inches apart, more preferably less than about 0.2 inches apart, still preferably less than about 0.1 inches apart, and most preferably about 0.05 inches apart, depending on the specific application. Alternatively the electrode pairs may not be evenly spaced along the pole piece.

Openings in the front and back of core 401 create flow channels 410. The flow channels may be holes, slots, a mixture thereof, a continuous slot, or of any other shape which allows fluid to through past the electrodes. Alternatively, the configuration may be different on the front and back of the core. Flow channels 410 may be formed with straight walls into core 401 or the channels may be tapered or scalloped. Preferably the flow channels 410 are funneled or tapered from the outside toward the inside to allow inflow from a larger area to pass through the flow sensor 400 and yet leave enough core material to keep the magnetic flux high and substantially constant. Alternatively, the same area of a casing wall may be sensed with fewer sensors by using larger funnels tapered and directing fluid from a larger area to the sensors. The number of flow channels generally is less than fifty, more preferably is between one and about thirty, more preferably is between about five and about twenty-five, still more preferably is between about ten and about twenty, and most preferably is about fifteen. Preferably, the individual flow channels are separated from each other with dielectric shielding as disclosed in WO Publ. No. 2005/033633 A2, incorporated by reference hereinabove. Moreover, any of the shield shapes and configurations disclosed in the above reference may be implemented as the flow channels in the present application.

All open volumes within sensor 400 except for the flow channels 410 preferably are filled with a dielectric potting material such as an epoxy, plastic, enamel, composite, or the like. In addition to assisting with formation of the flow channels, the potting material can enable the sensor to better handle the extreme pressures and temperatures found downhole in a wellbore. Preferably, all or most surfaces are protected by a protective layer of potting or another material, except for the conductive surfaces of the electrodes exposed to fluid flow in the flow channels.

Figure 6B:
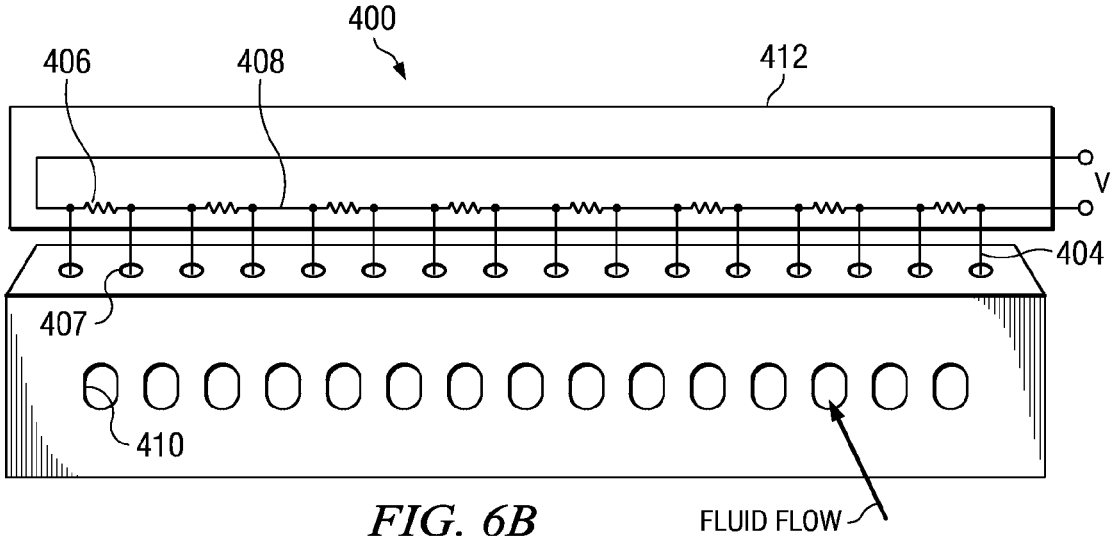

FIG. 6B shows another embodiment of flow sensor 400. Electrodes 404 protrude through openings 407 in one side of core 401. One electrode pair is disposed in flow channel 410. Electrodes 404 are electrically connected to a printed wiring board (PWB) 412 (also known as a printed circuit board (PCB)) located outside of core 401. Preferably PWB 412 is mounted on a side of sensor housing 301, and is protected from the ambient environment by a covering of potting material or some other form of protective enclosure or housing. PWB 412 could alternatively be mounted inside core 401.

In a preferred embodiment, each electrode pair is connected by resistor 406, and adjacent electrode pairs are connected in series by direct electrical connection 408 (e.g., wire or circuit trace). Alternatively, electrodes 404 may be directly connected to a resistor network or wiring harness without a printed circuit board. A voltage measured at V is representative or indicative of the presence or absence, as well as the direction (from the sign, + or −, of the voltage) and extent (e.g., quantity or velocity), of the flow of conductive fluid through one or more of flow channels 410. In this embodiment, each opening 407 has only one electrode, and so the electrodes 404 are paired in every other flow channel 410. Alternatively, an electrode pair is associated with each flow channel, in which case each opening 407 (except for the outermost openings) would have two electrodes in it, one for each of the adjacent flow channels. Alternatively, there may be additional openings 407 to accommodate the additional electrodes.

Figure 6C:
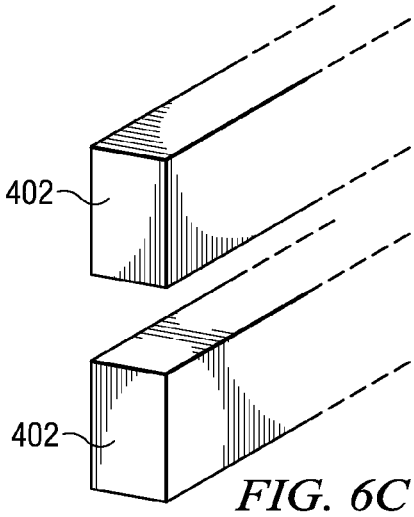
Figure 6D:
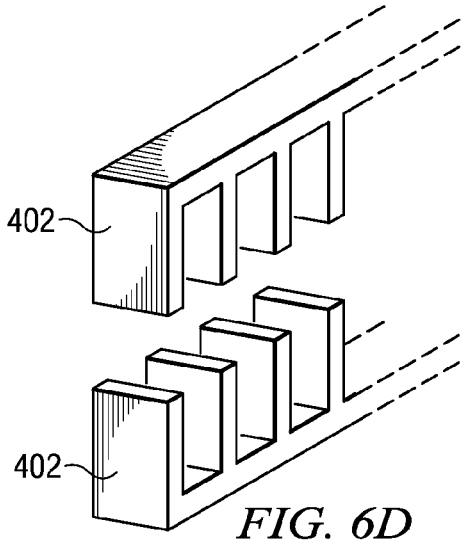

FIGS. 6C and 6D illustrate alternative embodiments for the core pole pieces 402. In FIG. 6C, each pole piece 402 is a continuous block running the length of the sensing area. In FIG. 6D, each pole piece has portions removed such that the two pole pieces have individual pole projections or teeth that may be aligned with each flow channel. The reduced core pole material of each pole piece in close proximity to the other piece has the effect of concentrating the magnetic flux at the flow channel, providing a stronger magnetic field and improved measurement sensitivity. Alternatively, a non-rectangular shape of the core, such as oval or circular, may be used. As another alternative, portions of the core interior not otherwise used may be filled with a waterproof material such as epoxy, enamel, plastic, composite or the like, except in the flow channels.

Figure 6E:
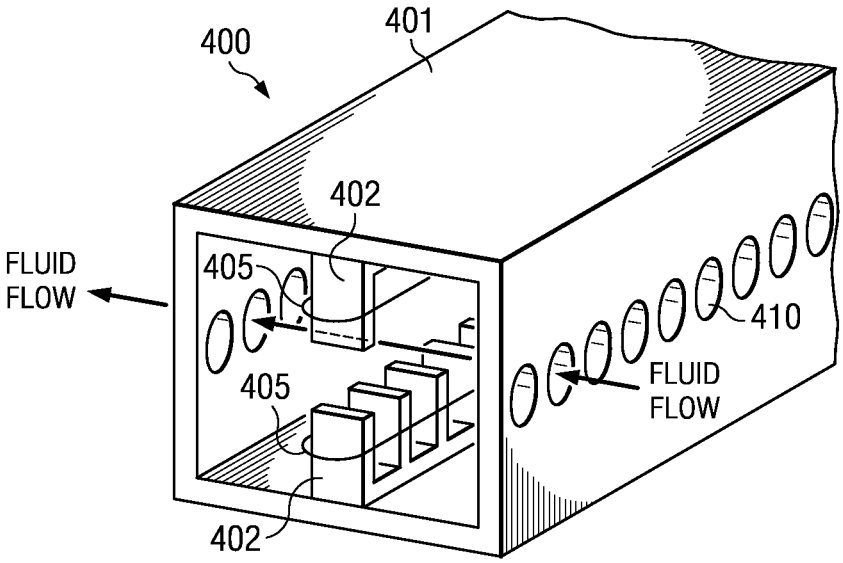
Figure 6F:
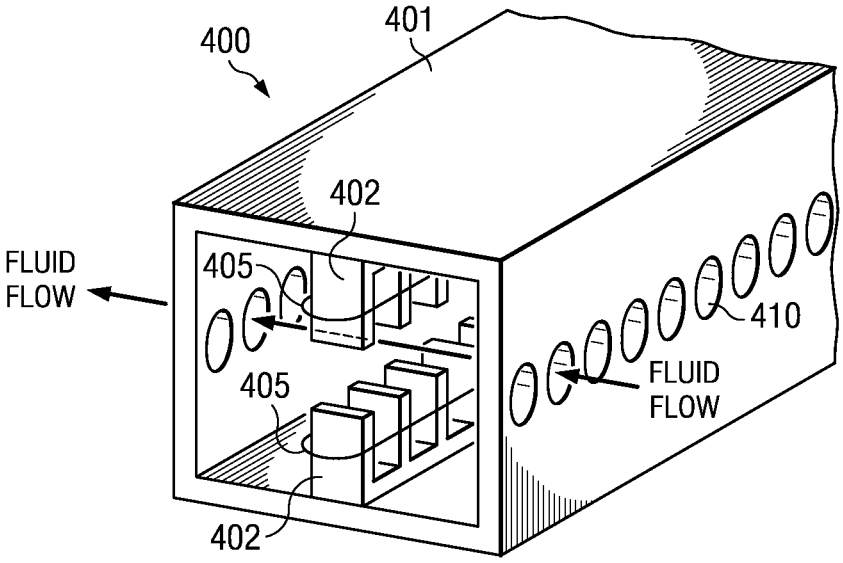

The implementation of the pole pieces of FIG. 6D is shown in FIG. 6E. This embodiment is similar to that shown in FIG. 6A, except that the core pole pieces 402 with pole projections or teeth are used, and both pole pieces 402 are surrounded by coils 405. For the sake of clarity, only one of the pole projections for the upper pole piece 402 is shown, and the electrodes are not shown. Fluid flow is funneled into flow channel 410, which passes between the faces of corresponding pole teeth on the two pole pieces 402. FIG. 6F illustrates similar components and features with additional pole projections shown for the upper pole piece.

Figure 6G:
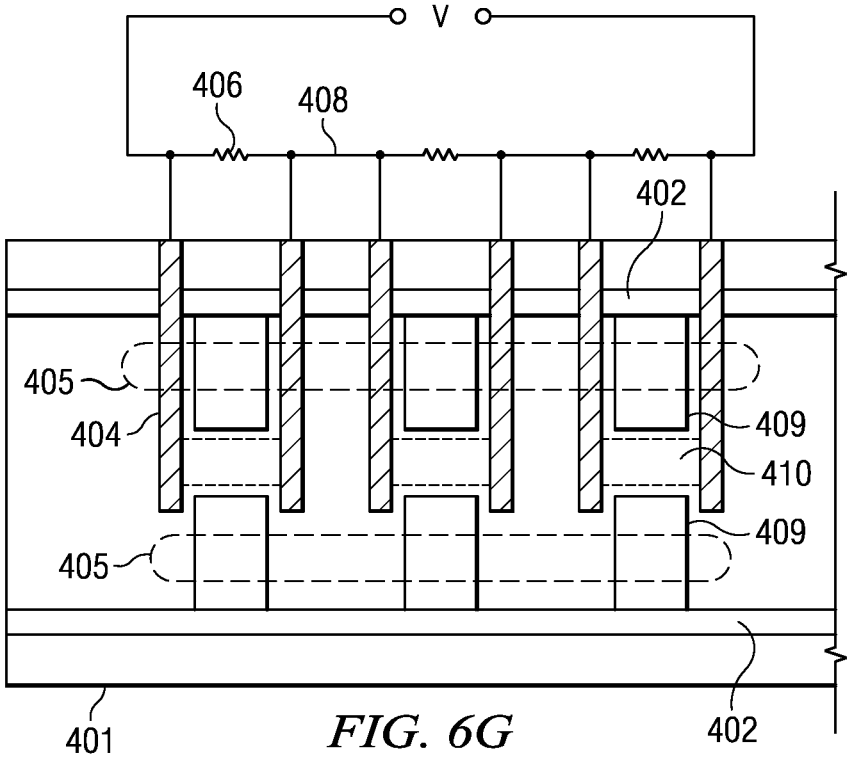
Figure 6H:
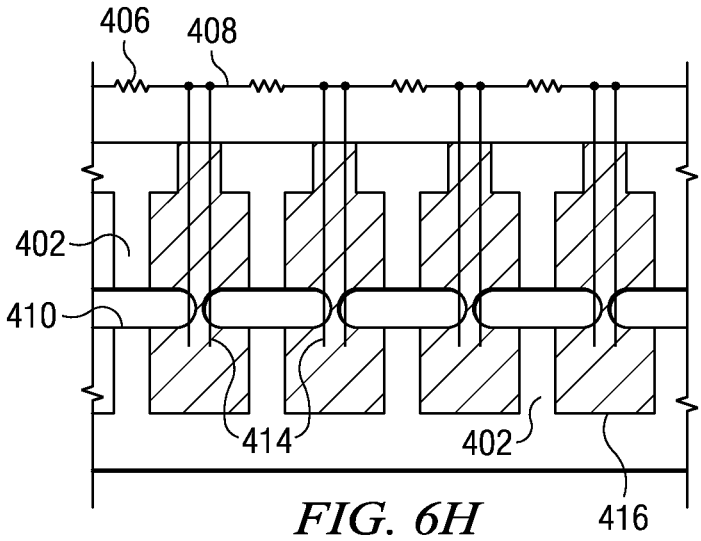

FIG. 6G is a combination schematic and cross section showing the relationship of electrodes 404 to the other components. In this embodiment, electrode pairs are implemented in every flow channel. Poles 409 are shown at the end of each core pole piece adjacent the flow channel. FIG. 6H illustrates similar components, with electrode pair 414 shown disposed at each side of a flow channel 410. In addition, potting material 416 surrounding the flow channels and filling in all other open spaces in the sensor is shown.

Figure 6I:
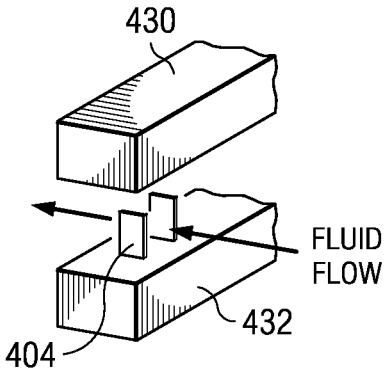
Figure 6J:
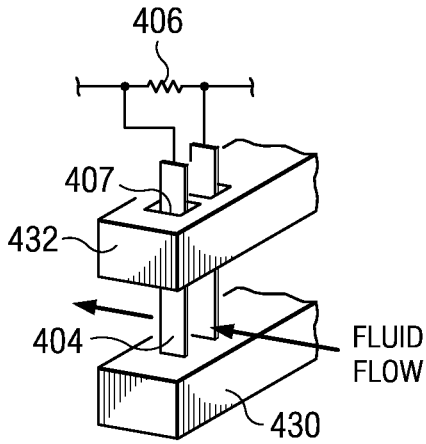

FIG. 6I illustrates an alternative embodiment in which the coil and magnetic material have been replaced with permanent magnets 430 and 432. The magnets may be used with or without a surrounding core, so long as flow channels exist for guiding fluid to flow between the magnets. In this example the lower side of magnet 430 is the south pole face and the upper side of magnet 432 is the north pole face. The electromagnetic sensing operation of conductive fluid flow with electrodes 404 is essentially the same as before. FIG. 6J illustrates another embodiment with permanent magnets 430, 432. Electrodes 404 are disposed in the gap between the north and south poles through openings 407 in permanent magnet 432. As discussed previously, the electrode pair is electrically connected by resistor 406 and a voltage measured across the two electrodes is representative of conductive fluid flow in the gap between the two electrodes.

Figure 6K:
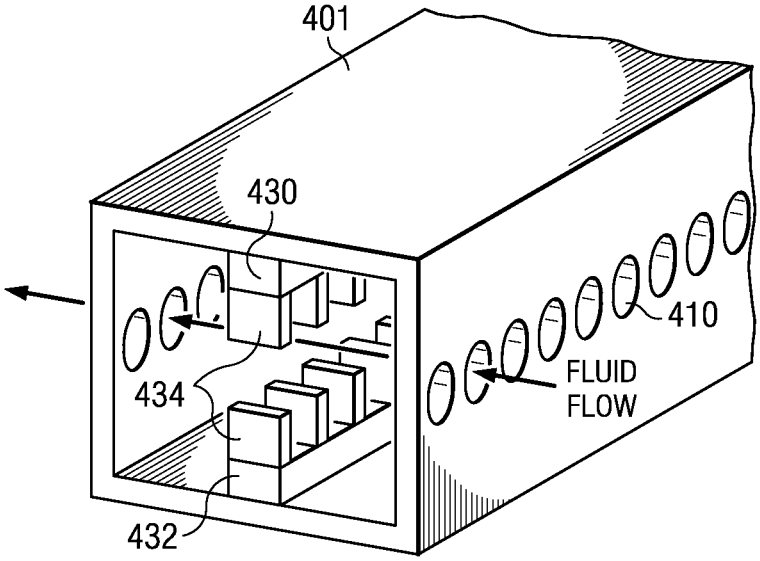

FIG. 6K illustrates another embodiment with permanent magnets 430, 432. In this embodiment the magnets are disposed within core 401 and have ferromagnetic projections or teeth 434 on either side of flow channel 410. For clarity, electrodes are not shown in this figure, but may be implemented as shown in other embodiments disclosed herein. The permanent magnets may comprise materials such as rare earth magnets (e.g., neodymium magnets, or samarium cobalt magnets), alnico magnets, ceramic magnets, and the like. The ferromagnetic teeth may comprise the same materials as the core material described hereinabove.

Figure 7A:
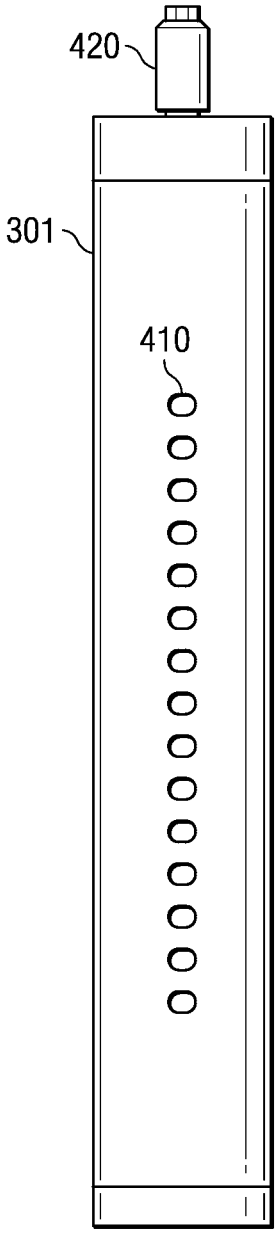
FIGS. 7A-7E illustrate various views of a sensor housing.
Figure 7D:
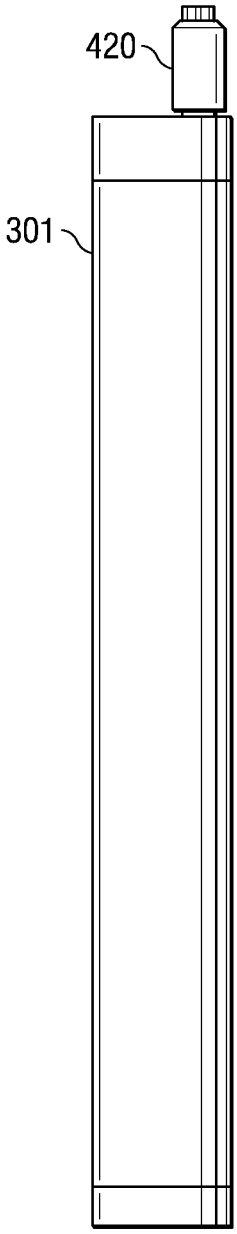
Figure 7E:
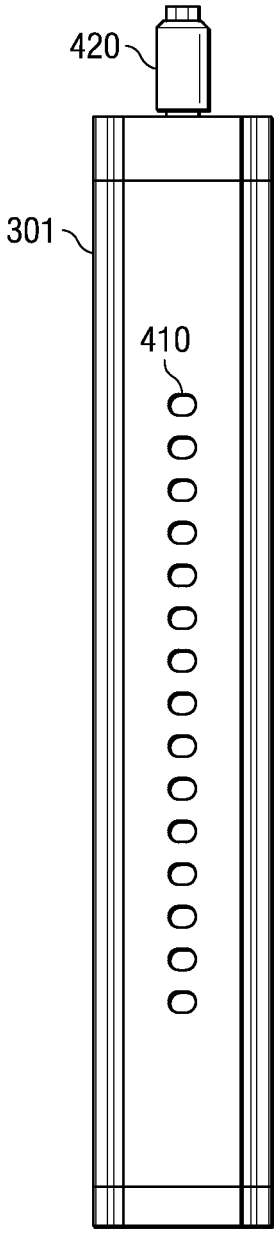
Figure 7B:
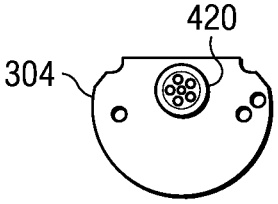
Figure 7C:
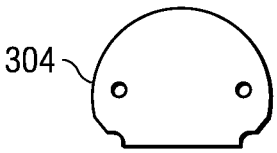

FIG. 7 illustrates a preferred embodiment sensor housing 301, with FIG. 7A showing the front, FIG. 7B showing the top, FIG. 7C showing the bottom, FIG. 7D showing one side, and FIG. 7E showing the back. The side opposite the side shown in FIG. 7D is the minor image of FIG. 7D. Flow channels 410 pass through sensor housing 301 from the front shown in FIG. 7A to the back shown in FIG. 7E. In addition, wire bundle 420 is shown projecting from the top of sensor housing 301, which provides for external electrical connections.

Figure 8A:
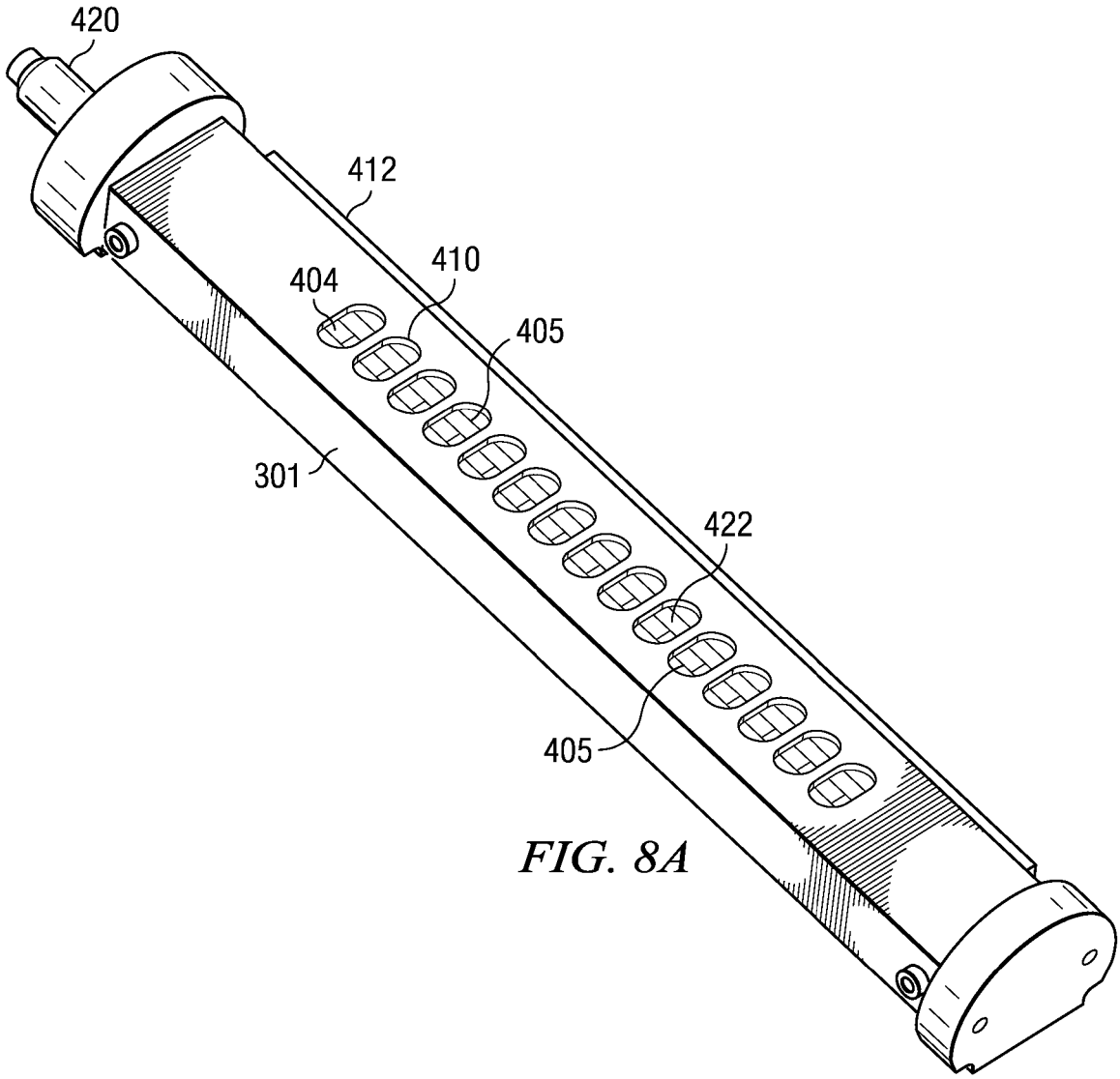
FIGS. 8A-8E illustrate various components of a sensor housing.
Figure 8B:
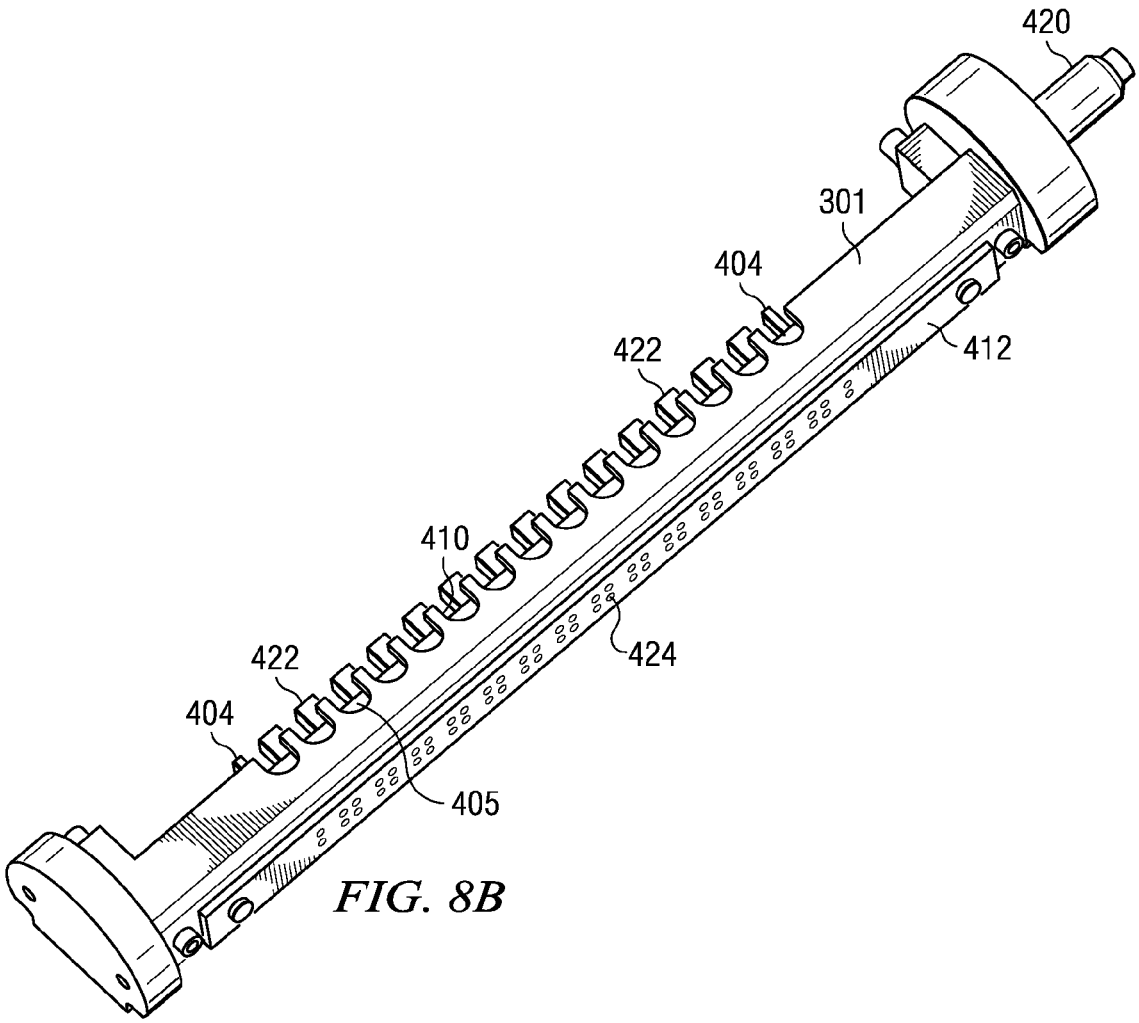

FIGS. 8A through 8E show further details of the sensor housing of FIG. 7. The potting material is not shown in any of these figures so that other components can be seen. In FIG. 8A, PWB 412 is shown mounted on a side of sensor housing 301. In addition, portions of coils 405 and electrodes 404 are visible inside flow channels 410. Also visible is insulation 422 insulating portions of electrodes 404. In FIG. 8B, half of the sensor housing 301 has been removed, along with its associated pole piece and coil, to better observe the housing's inner components. PWB 412 also is more visible in this figure, with electrode connections 424 shown on the surface of PWB 412.

Figure 8C:
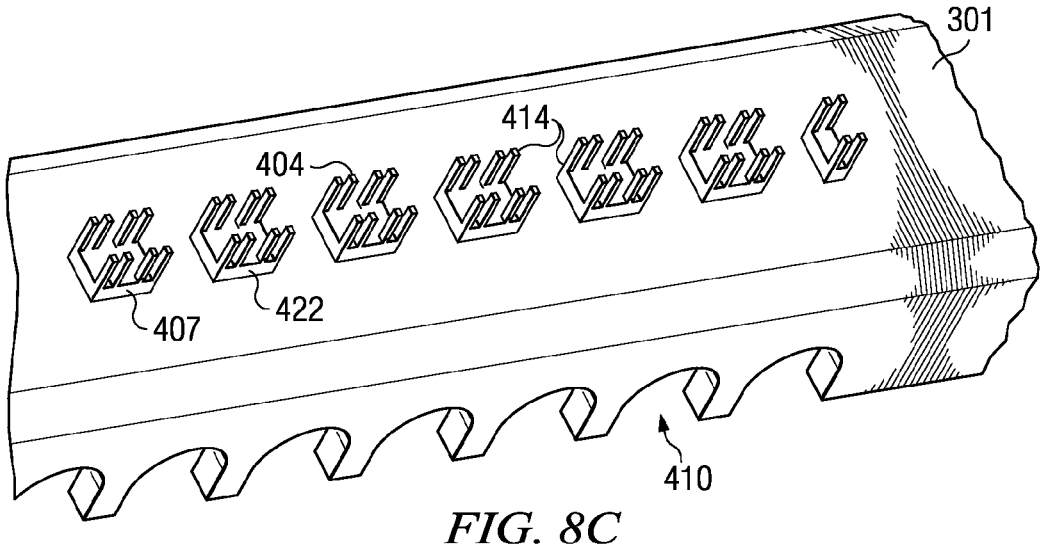

FIG. 8C illustrates a side section of sensor housing 301 with the PWB removed. The PWB connection portion of electrodes 404 can be seen protruding through openings 407 in the side of housing 301. Furthermore, each electrode pair 414 is aligned with its associated flow channel 410. Alternatively, the electrodes may be mounting differently, such as on a side piece that goes out and down into a holder.

Figure 8E:
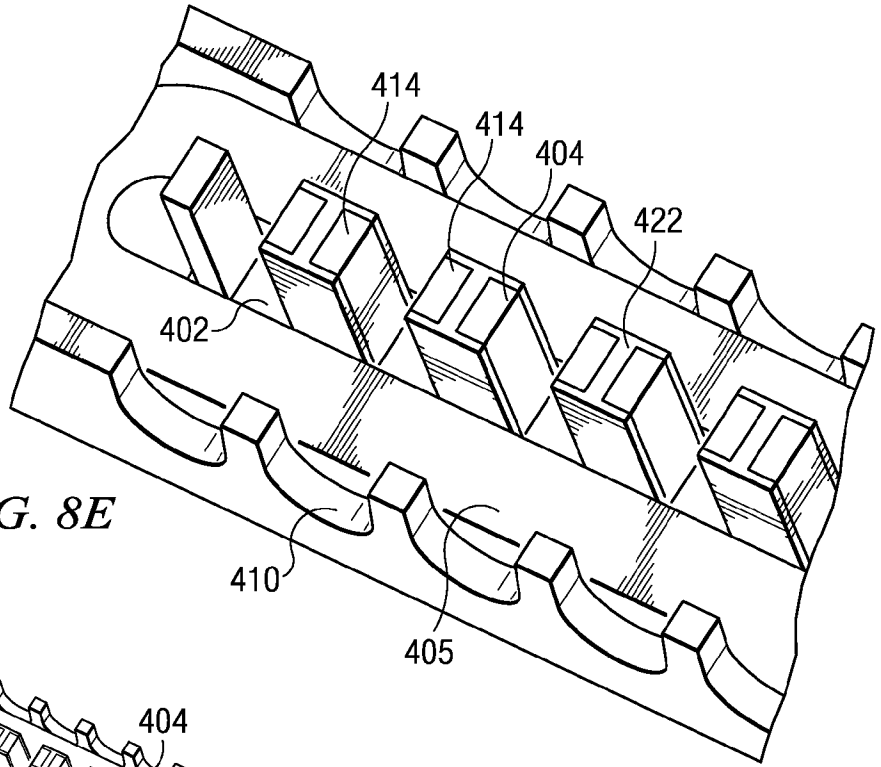
Figure 8D:
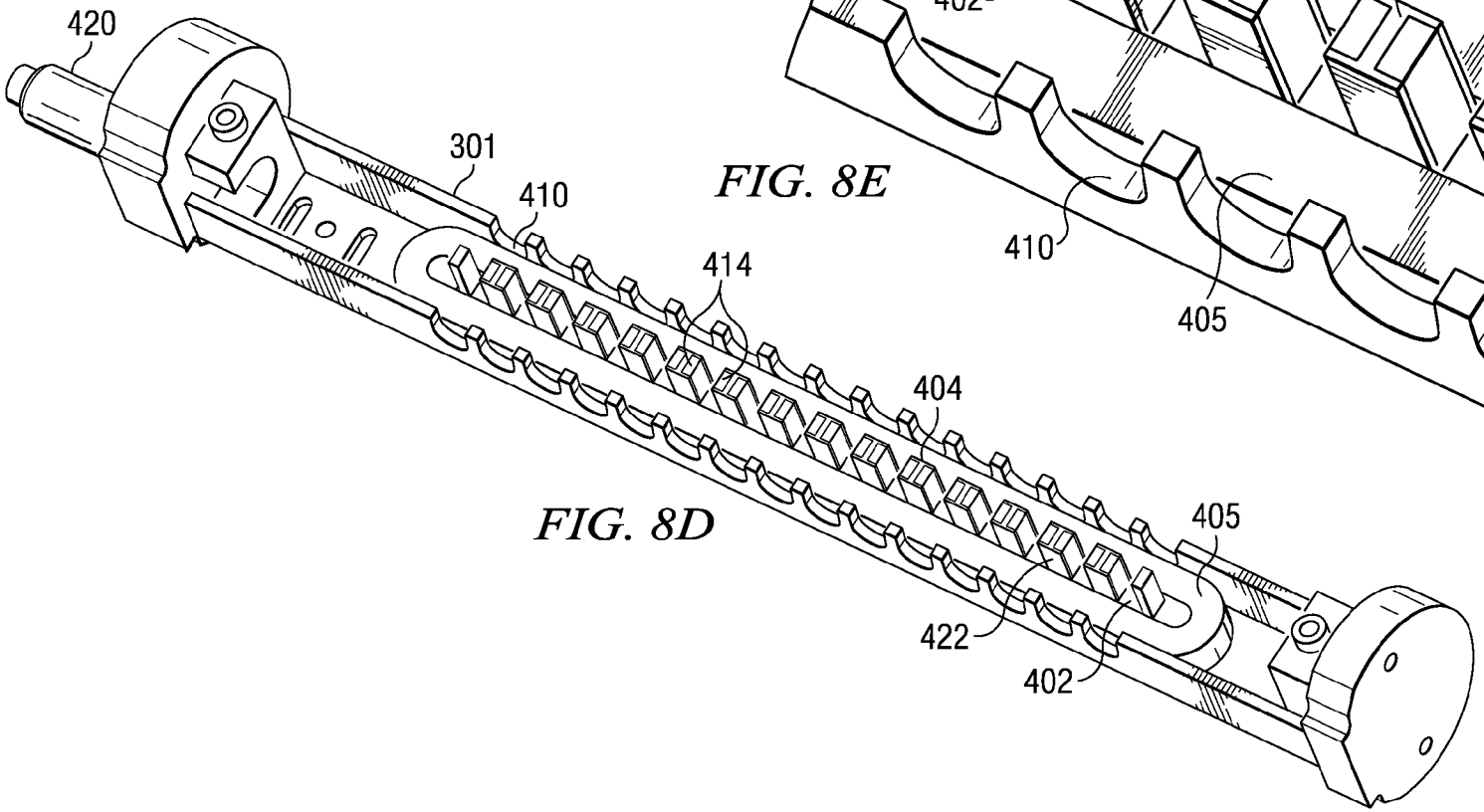

FIG. 8D shows the interior of the side section of sensor housing 301. In this figure, sections of core 402 are visible adjacent electrode pair 414, and a majority of coil 405 is visible surrounding core 402. FIG. 8E is an expanded view of a portion of FIG. 8D, providing a more detailed view of the relationships between electrodes 404, insulator 422, core 402, coil 405, and flow channel 410.

Figure 9:
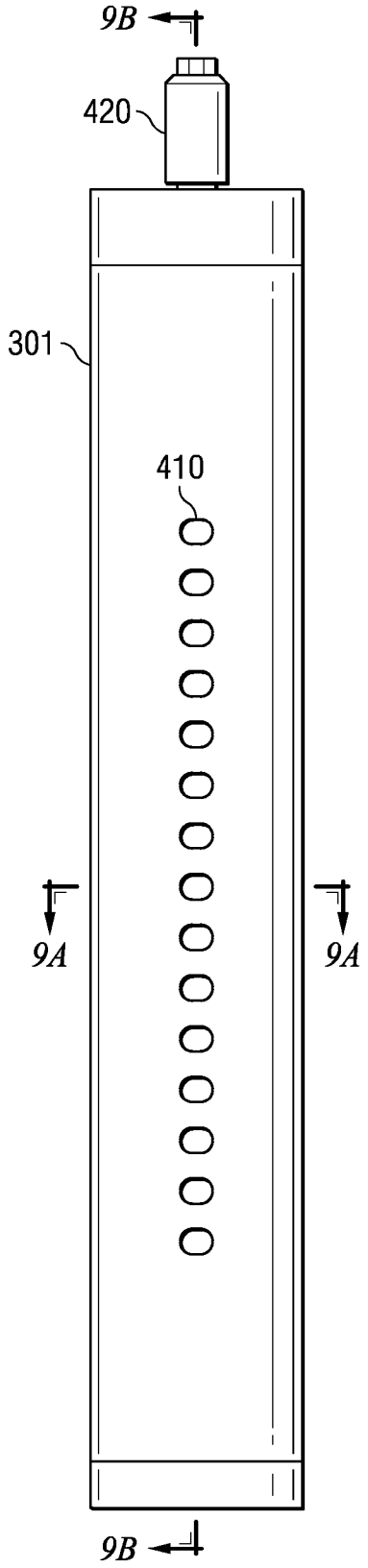
FIGS. 9-9C show various views of a sensor housing.
Figure 9B:
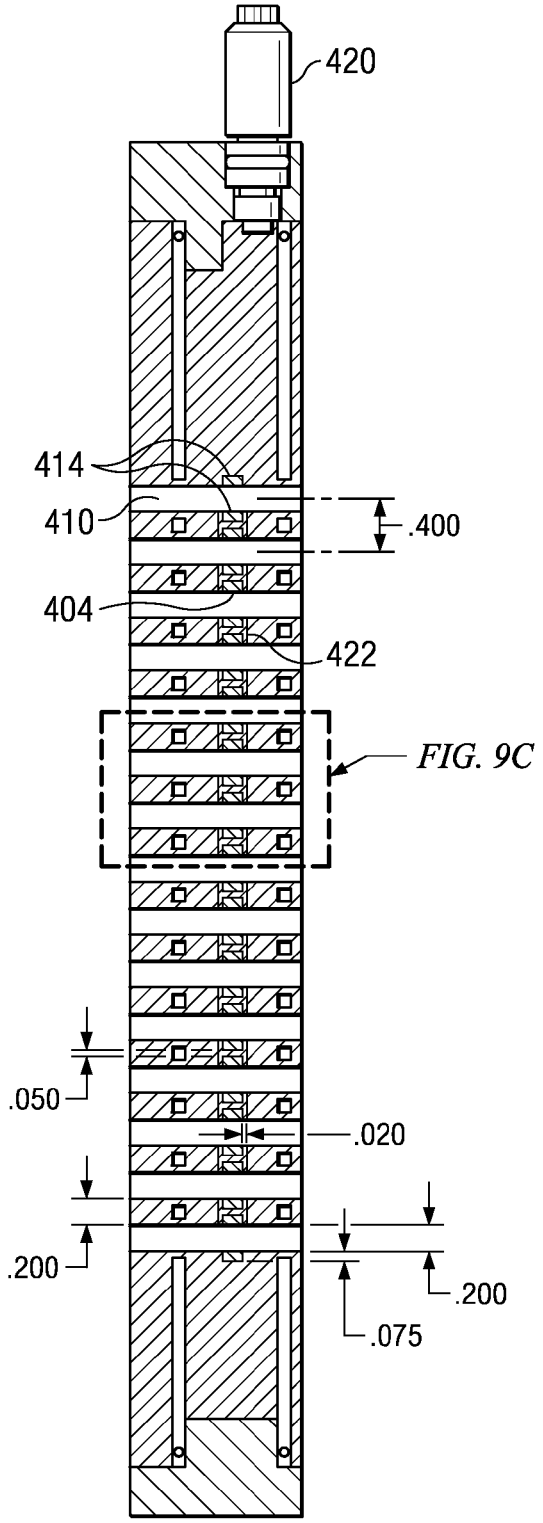
Figure 9A:
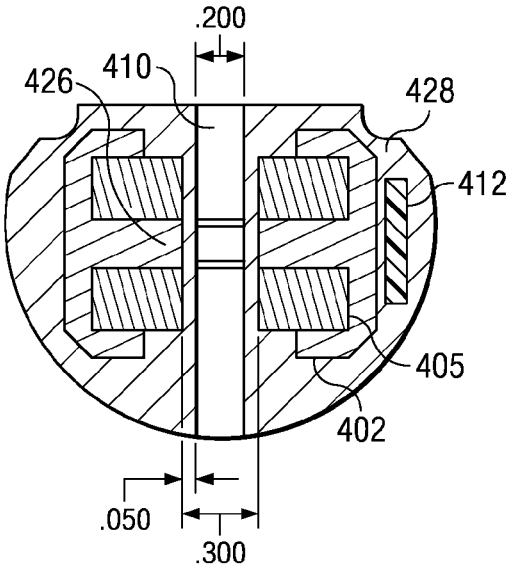
Figure 9C:
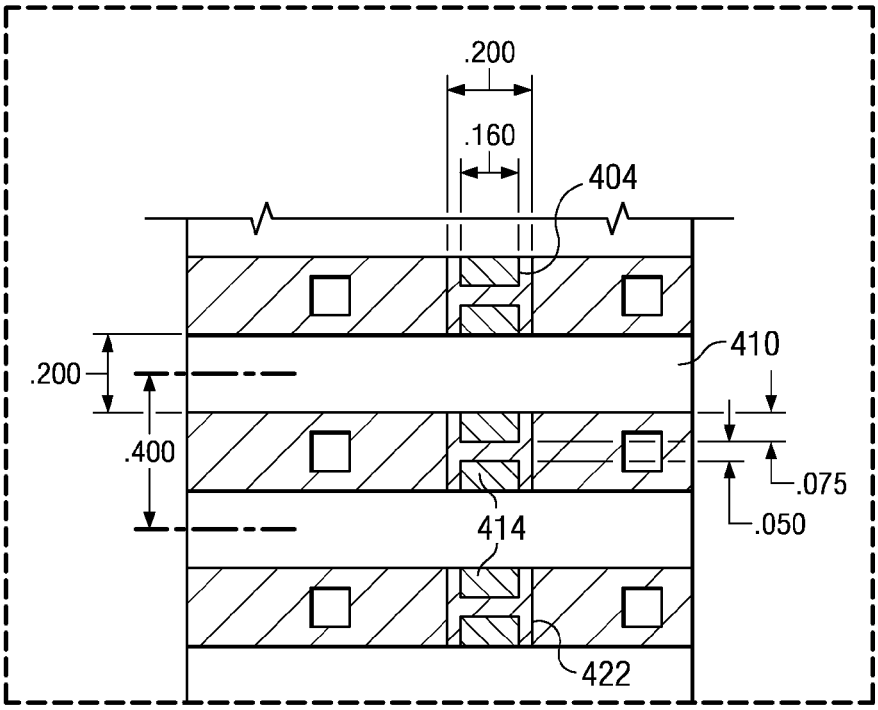

FIGS. 9-9C illustrates another preferred embodiment of sensor housing 301 and its associated components, along with example dimensions of various features. Of course, many other dimensions are possible for many different embodiments, all of which are within the scope and spirit of the present invention. FIG. 9 is an external view of the front of sensor housing 301. FIG. 9A is a cross section of sensor housing 301 from an end perspective. Pole 426 is shown for one of the pole piece projections, and potting material 428, such as molded epoxy, is shown surrounding most components. FIG. 9B is a cross section of sensor housing 301 from a side perspective, while FIG. 9C is an expanded view of a portion of the assembly of FIG. 9B.

Figure 10A:
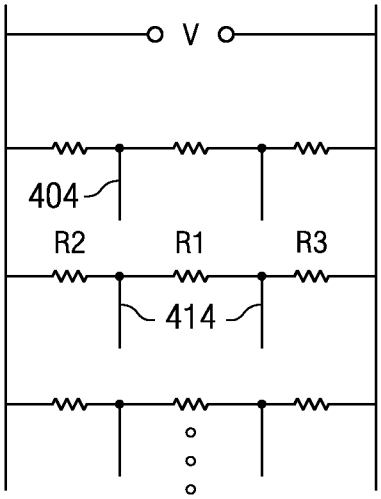
FIGS. 10A-10C illustrate various electrode/resistor network embodiments.
Figure 10B:
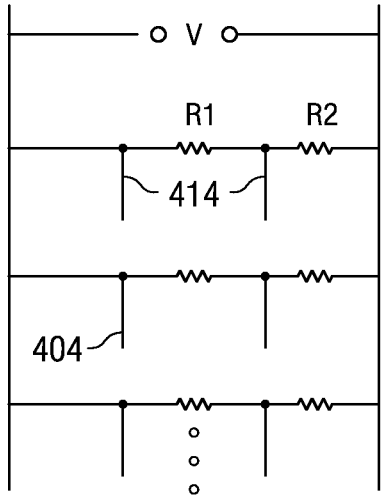
Figure 10C:
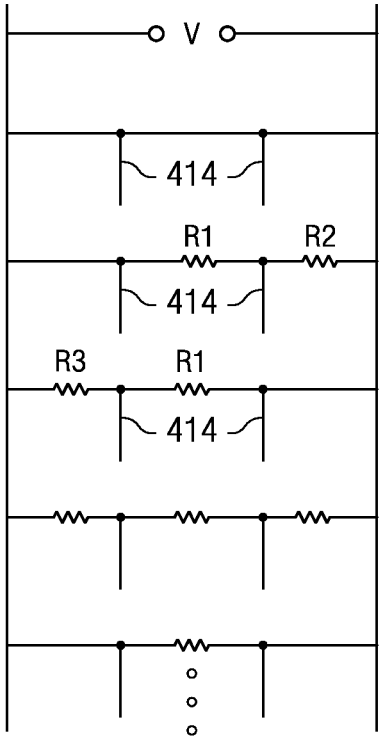

FIGS. 10A-10C illustrate various alternative embodiments for the electrode/resistor network. In previously discussed embodiments, each electrode pair and its associated resistor were connected to other such elements in series, or there may be an additional resistor between each adjacent electrode pair. Alternatively, the electrode pairs may be connected in series without any resistors. Alternatively, the electrode pairs may be connected to each other in parallel, with the voltage V measured across all the electrode pairs in parallel. FIG. 10A illustrates one such embodiment, where electrode pair 414 has a resistor R1 electrically connected between the two electrodes. One electrode is connected to one side of a network ladder through resistor R2, while the other electrode is connected to the other side of the network ladder through resistor R3. Resistor R1 helps make the output voltage substantially insensitive to the presence of a non-conductive fluid, such as oil or gas, in the flow channel. Resistors R2 and R3 are used to reduce noise in the voltage measurements. The resistor values may be selected to be between about 1K ohms and about 100 M ohms, more preferably between about 10K ohms and about 10 M ohms, still more preferably between about 50K ohms and 5 M ohms, and most preferably about 100K ohms.

Alternatively, as shown in FIG. 10B, the resistors may only be used to connect to one side of the network ladder, while the other electrode is connected directly to the other side of the ladder. As another alternative, difference ones of the various electrode pairs may be connected in the same network with both, one or the other, or neither of the ladder resistors, in any combination, as shown in FIG. 10C. As yet another alternative, for either the serial or parallel network, voltages for each electrode pair or a sub-group of the electrode pairs may be measured separately to provide even greater precision in determining the location of conductive fluid flow through the casing wall.

Although the present invention and its advantages have been described in detail, it should be understood that various changes, substitutions and alterations can be made herein without departing from the spirit and scope of the invention as defined by the appended claims. For example, many of the features detailed herein may be combined with the applicable features described in previously referenced U.S. Pat. No. 6,711,947 and WO Publ. No. 2005/033633 A2.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A conductive fluid flow measurement device comprising:

a core enclosure having first, second, third and fourth sides;

a first pole piece having a first face and disposed inside the first side the core enclosure;

a second pole piece having a second face and disposed inside the second side of the core enclosure opposite the first side, wherein the first and second faces face each other and are separated by a gap;

one or more flow channels disposed from the third side of the core, through the gap, to the fourth side of the core opposite the fourth side; and one or more electrode pairs, wherein each electrode pair is disposed in a respective one of the one or more flow channels adjacent the gap, and wherein, for each electrode pair, an imaginary line between the two electrodes in the electrode pair is substantially parallel to the faces and substantially orthogonal to a flow axis of the respective flow channel.

2. The conductive fluid flow measurement device of claim 1, further comprising between about five and about twenty-five of the electrode pairs and respective flow channels, and wherein the flow channels are spaced along a length of the core enclosure.

3. The conductive fluid flow measurement device of claim 1, further comprising between about ten and about twenty of the electrode pairs and respective flow channels, and wherein the flow channels are spaced along a length of the core enclosure.

4. The conductive fluid flow measurement device of claim 1, further comprising a first coil disposed substantially around sides of the first pole piece and substantially parallel to the first face.

5. The conductive fluid flow measurement device of claim 4, further comprising a second coil disposed substantially around sides of the second pole piece and substantially parallel to the second face.

6. The conductive fluid flow measurement device of claim 5, further comprising a current source electrically connected to the first and second coils.

7. The conductive fluid flow measurement device of claim 1, wherein the core enclosure and the pole pieces comprise a high magnetic permeability material.

8. The conductive fluid flow measurement device of claim 1, further comprising a resistor electrically connecting the two electrodes of each of the electrode pairs to each other.

9. The conductive fluid flow measurement device of claim 1, wherein the two electrodes in each of the electrode pairs are spaced less than about 0.25 inches from each other.

10. The conductive fluid flow measurement device of claim 1, wherein the one or more flow channels have tapered inlets/outlets.

11. The conductive fluid flow measurement device of claim 1, further comprising a printed circuit board disposed externally to the core enclosure, wherein the one or more electrode pairs extend through one or more openings in the first side of the core and connect to a resistor network disposed on the printed circuit board.

12. The conductive fluid flow measurement device of claim 1, further comprising a potting material disposed inside the core enclosure, substantially filling any space not occupied by and the flow channels and any other components inside the enclosure.

13. The conductive fluid flow measurement device of claim 1, further comprising one or more electrical shields disposed between the one or more electrode pairs.

14. The conductive fluid flow measurement device of claim 1, wherein there are multiple electrode pairs and multiple respective flow channels.

15. The conductive fluid flow measurement device of claim 14, wherein the first and second pole pieces further comprise pole projections extending to the gap for each of the flow channels, and wherein there are recesses in the pole pieces between adjacent projections.

16. The conductive fluid flow measurement device of claim 14, wherein the electrode pairs are connected to each other in parallel.

17. A conductive fluid flow measurement device comprising:

a core enclosure;

first and second permanent magnets disposed adjacent the core enclosure; and a plurality of electromagnet conductive fluid sensors disposed in the core enclosure, each electromagnetic conductive fluid sensor comprising a first pole projection and a second pole projection disposed on the first and second permanent magnets, respectively, within the core enclosure and separated by a gap;

a flow channel disposed within the core enclosure proximate to the gap, the flow channel having a flow axis passing through the gap; and an electrode pair disposed in the flow channel adjacent the gap, wherein an imaginary line between two electrodes in the electrode pair is substantially orthogonal to a magnetic field between the first and second pole projections, and substantially orthogonal to a flow axis of the flow channel.

18. The conductive fluid flow measurement device of claim 17, wherein the first and second permanent magnets are disposed inside the core enclosure.

19. The conductive fluid flow measurement device of claim 17, wherein the first and second permanent magnets are disposed outside the core enclosure.

20. The conductive fluid flow measurement device of claim 17, wherein the first and second permanent magnets comprise a material selected from the group consisting of: rare earth magnets, alnico magnets, and ceramic magnets.

21. The conductive fluid flow measurement device of claim 17, wherein the first and second pole projections comprise a ferromagnetic material.

22. The conductive fluid flow measurement device of claim 17, further comprising between about five and about twenty-five of the electromagnetic conductive fluid sensors spaced along a length of the core enclosure.

23. The conductive fluid flow measurement device of claim 17, further comprising between about ten and about twenty of the electromagnetic conductive fluid sensors spaced along a length of the core enclosure.

24. The conductive fluid flow measurement device of claim 17, further comprising a resistor electrically connecting the two electrodes to each other.

25. The conductive fluid flow measurement device of claim 17, wherein the two electrodes are spaced less than about 0.25 inches from each other.

26. The conductive fluid flow measurement device of claim 17, wherein the flow channel has a tapered inlet and tapered outlet.

27. The conductive fluid flow measurement device of claim 17, further comprising a printed circuit board disposed externally to the core enclosure, and wherein the electrode pair extends through one or more openings in the core enclosure and connects to a resistor disposed on the printed circuit board.

28. The conductive fluid flow measurement device of claim 17, further comprising a potting material disposed inside the core enclosure, substantially filling any space not occupied by and the flow channels and any other components inside the enclosure.

29. The conductive fluid flow measurement device of claim 17, further comprising electrical shields disposed between the electromagnetic conductive fluid sensors.

30. A conductive fluid flow measurement device comprising:

first and second permanent magnets with opposite poles facing each other and separated by a gap;

a plurality of flow channels disposed within the device proximate to the gap, and configured such that a conductive fluid flowing through at least one of the flow channels passes through the gap; and a plurality of electrode pairs disposed adjacent the gap along a length of the first and second permanent magnets, each one of the electrode pairs configured to generate a voltage difference when the conductive fluid flows through a respective one of the flow channels.

31. The conductive fluid flow measurement device of claim 30, further comprising electrical shields disposed between adjacent ones of the electrode pairs.

32. The conductive fluid flow measurement device of claim 30, wherein the first and second permanent magnets comprise a material selected from the group consisting of: rare earth magnets, alnico magnets, and ceramic magnets.

33. The conductive fluid flow measurement device of claim 30, further comprising between about five and about twenty-five of the electrode pairs and respective flow channels.

34. The conductive fluid flow measurement device of claim 30, further comprising between about ten and about twenty of the electrode pairs and respective flow channels.

35. The conductive fluid flow measurement device of claim 30, further comprising a resistor electrically connecting two electrodes in each electrode pair to each other.

36. The conductive fluid flow measurement device of claim 30, wherein two electrodes in each electrode pair are spaced less than about 0.25 inches from each other.

37. The conductive fluid flow measurement device of claim 30, wherein the flow channels have tapered inlets/outlets.

38. The conductive fluid flow measurement device of claim 30, further comprising a printed circuit board, wherein each electrode pair connects to a respective resistor disposed on the printed circuit board.

* * * * *